US006482045B2

(12) United States Patent
Arai

(10) Patent No.: US 6,482,045 B2
(45) **Date of Patent: *Nov. 19, 2002**

(54) CONNECTOR SOCKET, CONNECTOR PLUG AND CONNECTOR ASSEMBLY

(75) Inventor: Junichi Arai, Isesaki (JP)

(73) Assignee: Hosiden Corporation, Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/530,566

(22) PCT Filed: Sep. 10, 1999

(86) PCT No.: PCT/JP99/04931

§ 371 (c)(1),
(2), (4) Date: May 3, 2000

(87) PCT Pub. No.: WO00/16449

PCT Pub. Date: Mar. 23, 2000

(65) Prior Publication Data

US 2002/0072275 A1 Jun. 13, 2002

(30) Foreign Application Priority Data

Sep. 11, 1998 (JP) ..... 10-258365

(51) Int. Cl.[7] ..... H01R 13/64
(52) U.S. Cl. ..... 439/680; 439/609
(58) Field of Search ..... 439/680, 660, 439/677, 607, 681, 378, 924.1, 609

(56) References Cited

U.S. PATENT DOCUMENTS

| | | | | |
|---|---|---|---|---|
| 4,820,204 A | | 4/1989 | Batty | |
| 4,960,388 A | * | 10/1990 | Frantz et al. | 439/404 |
| 5,108,311 A | * | 4/1992 | Nakazawa | 439/607 |
| 5,254,010 A | | 10/1993 | Davis | 439/108 |
| 5,885,088 A | * | 3/1999 | Brennan et al. | 439/680 |
| 6,036,549 A | * | 3/2000 | Wulff | 439/660 |
| 6,095,861 A | * | 8/2000 | Lin et al. | 439/607 |

FOREIGN PATENT DOCUMENTS

| | | | |
|---|---|---|---|
| EP | 0 477 856 A2 | 1/1992 | 13/629 |
| JP | 59-076081 | 5/1984 | H01R/13/64 |
| JP | 04-038682 | 3/1992 | H01R/13/639 |
| JP | 04-038683 | 3/1992 | H01R/13/639 |
| JP | 04-059075 | 5/1992 | H01R/13/46 |
| JP | 10012347 | 1/1998 | 13/648 |
| WO | WO 88/04481 | 6/1988 | H01R/13/514 |

OTHER PUBLICATIONS

European Search Report, Appl. No. EP 99943263, Aug. 2001, 2 pages.

* cited by examiner

*Primary Examiner*—P. Austin Bradley
*Assistant Examiner*—Ross Gushi
(74) *Attorney, Agent, or Firm*—Connolly Bove Lodge & Hutz LLP

(57) ABSTRACT

An insulator body 310 is held in a semicylindrical metallic cover 320. The insulator body includes a main body portion having a planar plate-like contact support 312 extending forwardly from the front end of the main body portion. A plurality of narrow strip contacts 330 are arranged on the opposite plate surfaces of the support 312. Key bosses 314, 345 extend forwardly from the insulator body 310 in such a fashion as to sandwich the contact support 312 therebetween. A part of an annular groove is defined between key bosses 314, 345 and metallic cover 320 for receiving a tubular metallic cover of a connector plug. The key boss 314 has a keyway formed in the surface thereof opposing the contact support 312 The connector provides for accommodating an increased number of contacts and preventing coupling between different types of connectors, and allows for reducing the size of the connector.

25 Claims, 21 Drawing Sheets

CONNECTOR SOCKET, CONNECTOR PLUG AND CONNECTOR ASSEMBLY

FIELD OF THE INVENTION

This invention relates to a connector assembly comprising a connector socket and a connector plug useful for interconnecting and disconnecting components of various types of electronic equipment.

BACKGROUND ART

Connectors known as mini-DIN type have heretofore been used extensively on a section of a personal computer where a keyboard is to be connected with the mainframe, for example. FIG. 1 illustrates a front view of the construction of a conventional mini-DIN connector socket 100 while FIG. 2 shows a perspective view of the construction of a typical mini-DIN connector plug 200.

The mini-DIN connector socket 100 comprises a semi-cylindrical insulator body 110 having its outer periphery covered with a metallic cover 120. The insulator body 110 has a plurality of contact accommodating apertures 111 formed in the front face (plugging-in/out face) thereof where there are accommodated contacts (not shown) from the rear ends of which the respective terminals 112 lead out and depend downwardly. The insulator body 110 further has a key hole 113 formed in the plugging-in/out face (front face) and an annular groove 117 extending generally along the outer periphery of the plugging-in/out face. Keyways 114, 115 and 116 are formed in the peripheral surface of the plugging-in/out face adjacent the annular groove 117 so as to extend in a longitudinal direction parallel to the direction in which the plug is inserted in and pulled out.

The face of the insulator body 110 from which the terminals 112 lead out is a flat surface which serves as a mount surface for mounting the connector socket 100 onto a printed-circuit board. Extending from the metallic cover 120 in the same direction as the terminals 112 are tabs 121 adapted to be inserted into the printed-circuit board (not shown) and soldered onto a conductor pattern (grounding conductor) to thereby electrically and mechanically connect the connector socket 100 with the printed-circuit board.

The connector plug 200 comprises a columnar insulator body 220 housed in a tubular metallic cover 210. A plurality of contact pins 230 extend from the front face of the insulator body 220 (the surface which will face the front face of the connector socket 100 for connection therewith). Mounted over the rear end portion of the metallic cover 210 is an insulation cover 240 which in turn protects the connections between the contact pins 230 and a cable (not shown).

It will be appreciated that upon inserting the connector plug 200 into the connector socket 100, the contact pins 230 are inserted into the contact accommodating apertures 111 of the connector socket 100 to bring the connector plug 200 and the connector socket 100 into electrical connection.

The metallic cover 210 of the connector plug 200 is formed in its peripheral wall with circumferentially spaced keys 211, 212, 213 protruding inwardly from the outer surface thereof. The key 211 complementarily engages with the keyway 114 of the connector socket 100 and similarly the keys 212 and 213 mates with keyways 115 and 116, respectively of the connector socket 100 to thereby determine the angular mating orientation of the connector plug 200 with respect to the connector socket.

Further extending from the face of the insulator body 220 of the connector plug 200 from which the contact pins 230 extend is a key 221 formed integrally with the insulator body 220 which complementarily engages with the key hole 113 formed in the front face of the insulator body 110 of the connector socket 100 to ensure that wrong connection is prevented between a connector socket 100 and a connector plug 200 which are different with respect to the number and/or arrangement of the contact pins.

As illustrated in FIGS. 1 and 2, the prior art mini-DIN connector, particularly the connector socket 100 is configured such that the insulator body 110 is formed with contact accommodating apertures 111 in which contacts are accommodated. As is commonly well known, however, there are difficulties with forming closely spaced apertures. Consequently, one problem with this construction is that the arrangement in which contact is established by contacting the rod-like contact pins 230 with the contacts in the contact accommodating apertures 111 imposes a limitation on reducing the spacings between the contact accommodating apertures 111, resulting in an undesirable restriction to the increase and variation in the number of contact pins.

The cylindrical connector socket 100 and connector plug 200 are connected by mating the key hole 113 with the key 221 in order to ensure proper connection between only the same type connector socket and connector plug with respect to the number and arrangement of the contact pins and to avoid erroneous connection. However, the arrangement of the contact pins has heretofore prevented the designer from adopting many different combinations of the key hole 113 with the key 221.

Accordingly, it is an object of this invention to provide a connector assembly comprising a connector socket and a connector plug which allows for easily varying the number of contact pins as well as increasing the number.

It is another object of this invention to provide a connector socket, a connector plug and a connector assembly which provides for discriminating many types of connectors to prevent connection between wrong types of connectors.

DISCLOSURE OF THE INVENTION

The connector according to this invention includes a contact support in the form of a planar plate provided in either the connector socket or the connector plug. A plurality of narrow strip contacts or thin line contacts extending in the connector plugging-in/out direction are arranged in juxtaposition with each other along at least one of the opposed plate surfaces of the support such that the narrow strip contacts may be brought into resilient contact with corresponding resilient or spring contacts provided in the other of the connector socket and the connector plug to establish connection between the connector socket and the connector plug.

According to one form of the connector socket of this invention, the connector socket includes a planar plate-like contact support disposed centrally inside of a generally cylindrical groove mating with a complementarily tubular metallic cover of a corresponding connector plug in which a plurality of narrow strip contacts extending in the connector plugging-in/out direction are arranged in juxtaposition with each other along at least one of the opposed plate surfaces of the support, and a key boss is disposed in the cylindrical groove in opposing relation with the at least one plate surface of the support so as to prevent wrong connection between different types of connector socket and connector plug.

According to one form of the connector plug of this invention, the connector plug includes an insulator body fitted in a tubular metallic cover in which the insulator body is formed in its front face with a cutout slit extending diametrically of the metallic cover, contacts extending in the connector plugging-in/out direction are arranged in diametrically spaced and juxtaposed relation with each other on at least one of the opposed flat surfaces of the slit, and a keyway is formed in the front face of the insulator body on the side of the at least one flat surface of the slit so as to prevent connection between different types of connector socket and connector plug.

BEST MODES FOR CARRYING OUT THE INVENTION

Figure 1:
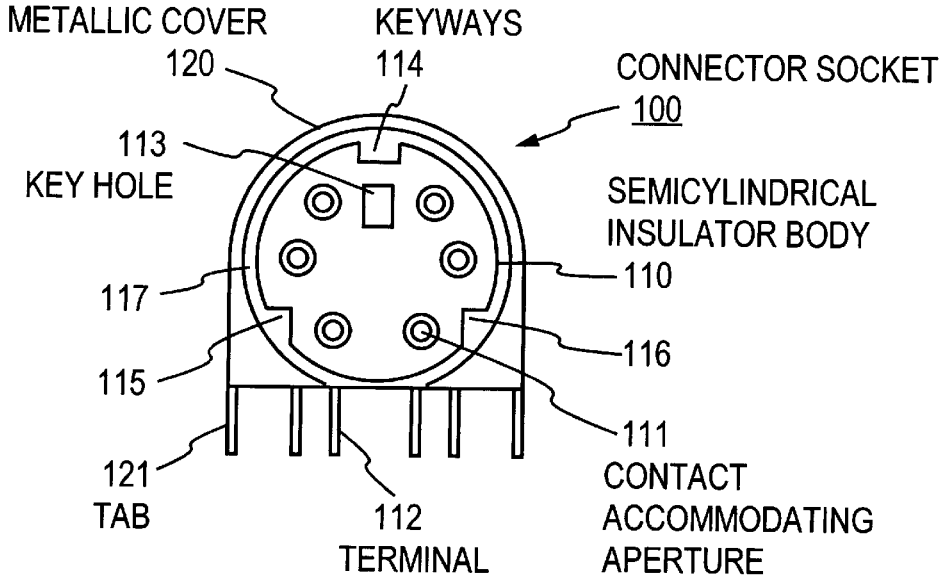
FIG. 1 PRIOR ART
FIG. 1 is a front view illustrating a conventional connector socket.
Figure 2:
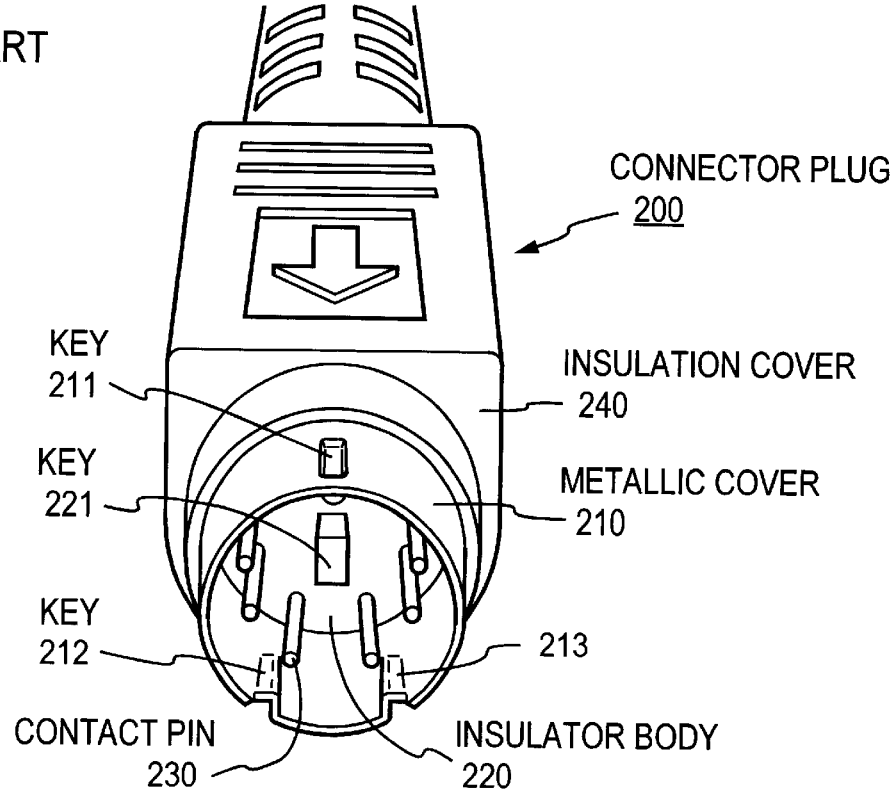
FIG. 2 PRIOR ART
FIG. 2 is a perspective view illustrating a conventional connector plug.
Figure 3:
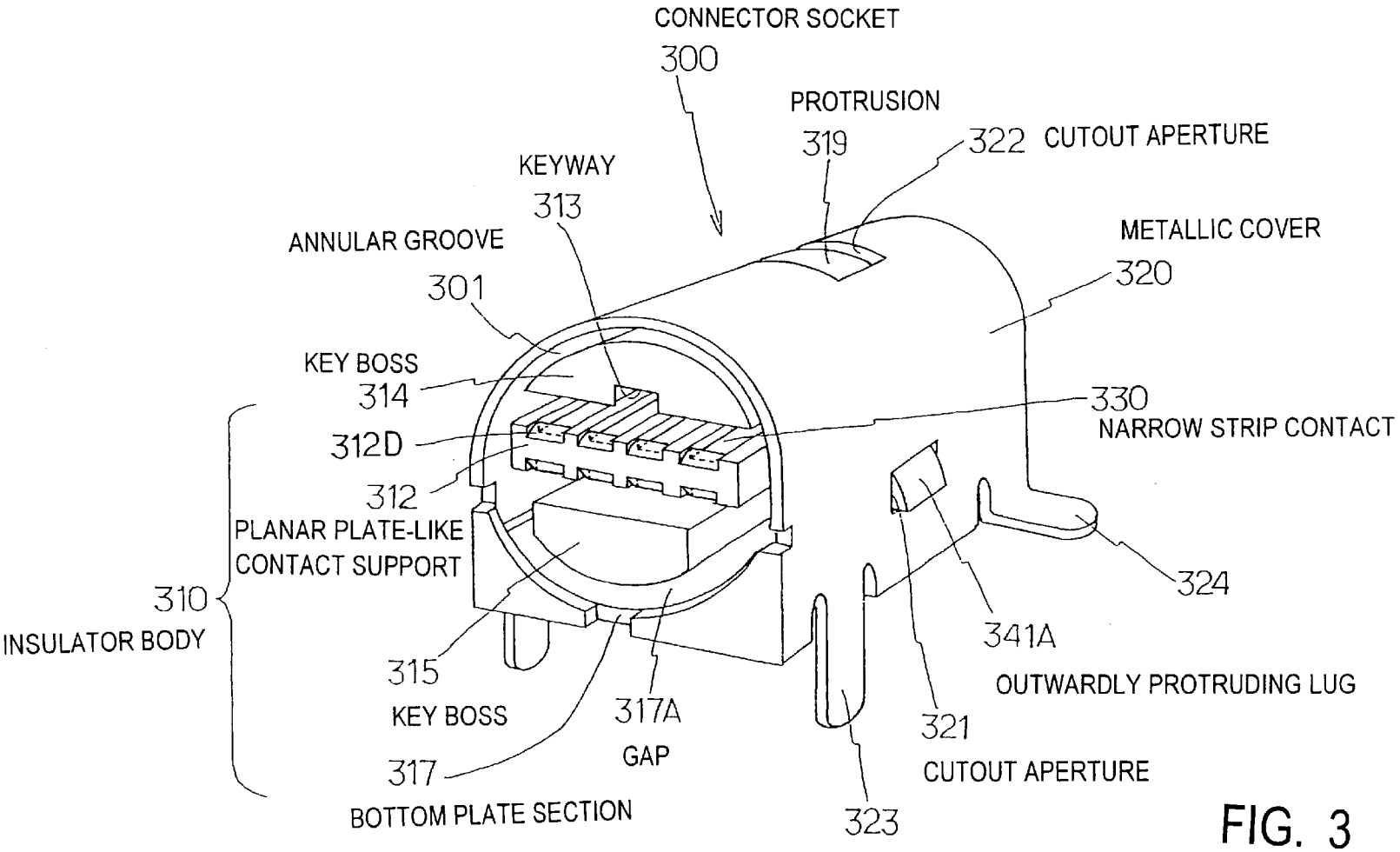
FIG. 3 is a perspective view illustrating one embodiment of the connector socket according to this invention.
Figure 4:
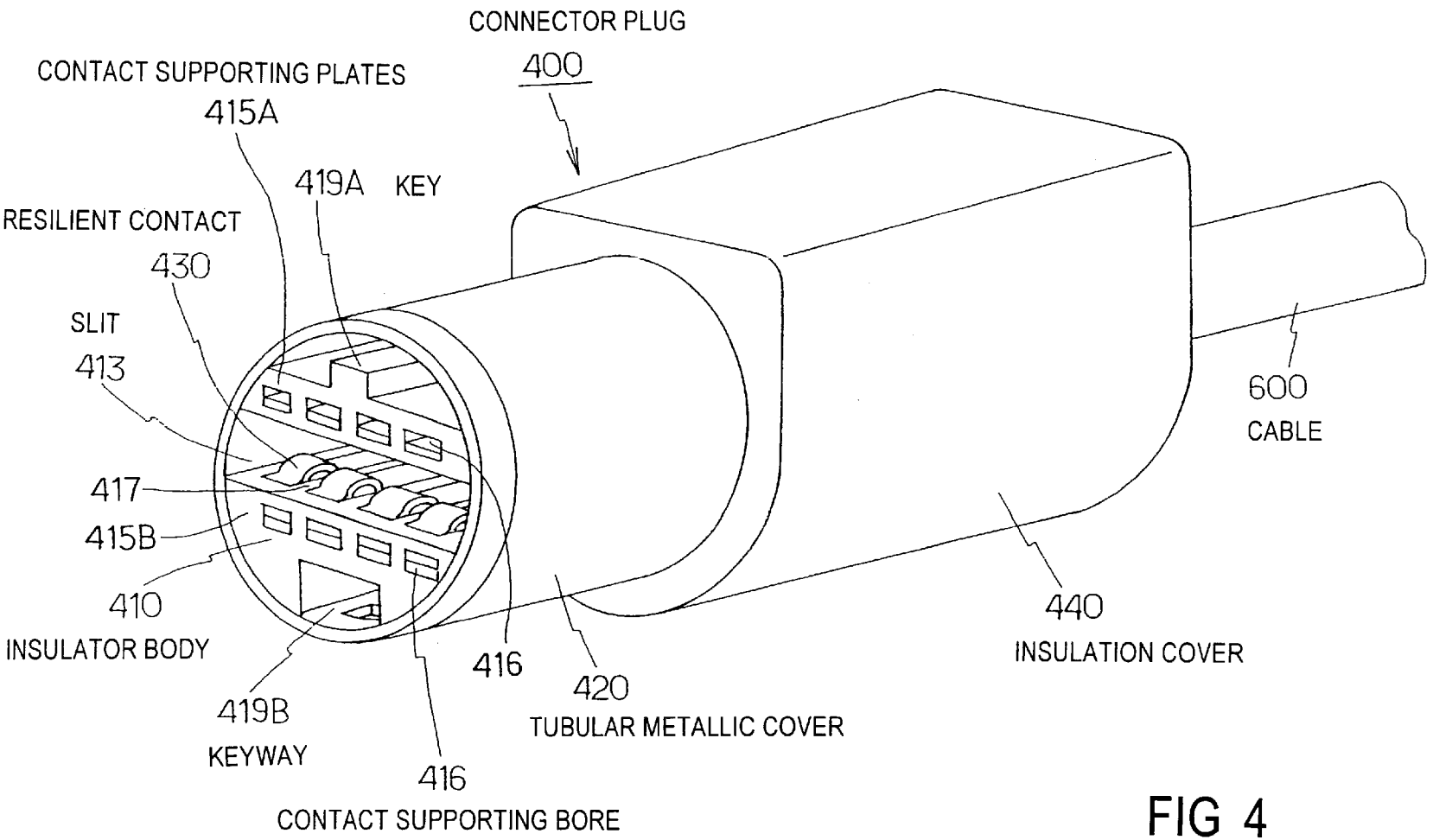
FIG. 4 is a perspective view illustrating one embodiment of the connector plug according to this invention.

FIG. 3 shows one embodiment of the connector socket forming part of the connector assembly according to this invention while FIG. 4 illustrates one embodiment of the connector plug forming part of the connector assembly according to this invention. In the embodiment shown in FIGS. 3 and 4, the connector socket 300 is provided with a planar plate-like contact support as shown in FIG. 3 and the connector plug 400 is provided with resilient or spring contacts as shown in FIG. 4.

Connector Socket

Figure 5:
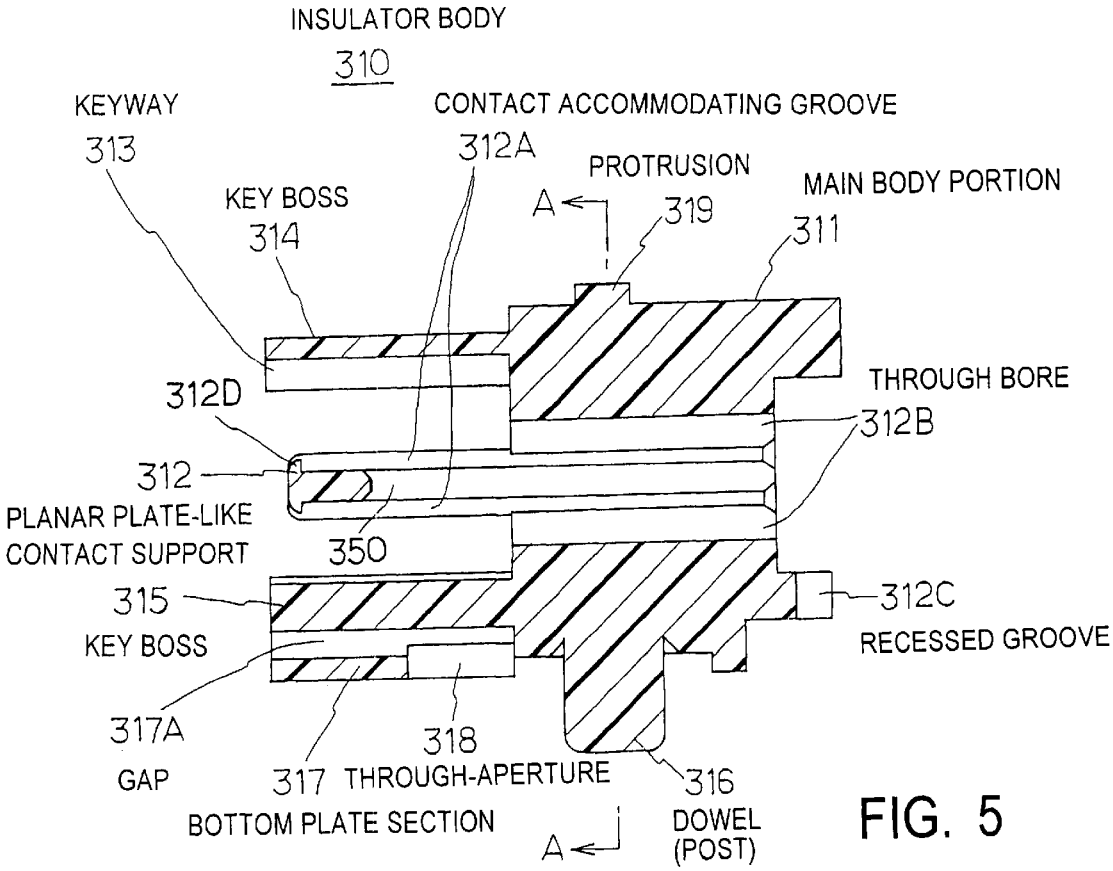
FIG. 5 is a cross-sectional view illustrating an insulator body 310 for use with the connector socket shown in FIG. 3.
Figure 6:
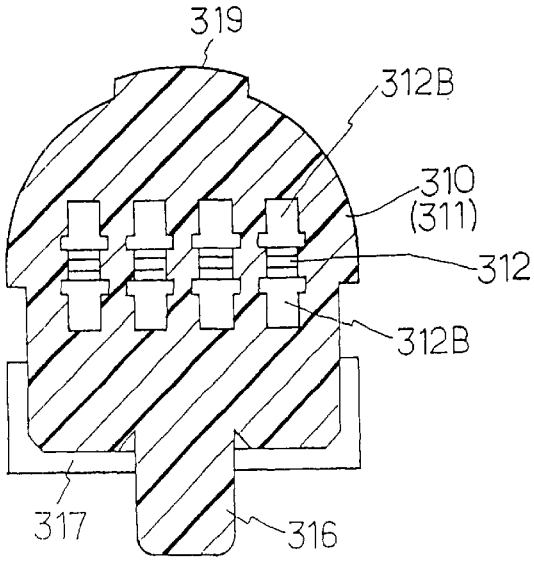
FIG. 6 is a cross-sectional view taken on line A—A in FIG. 5.

Referring first to FIG. 3, the specific construction of the connector socket 300 will be described. A semicylindrical insulator body 310 is covered with a metallic cover 320. 330 indicates narrow strip contacts or thin line contacts. As shown in FIG. 5, the insulator body 310 include a main body portion 311, a planar plate-like contact support 312 extending forwardly from the center of the front surface of the main body portion 311, and key bosses 314 and 315 extending forwardly from the front surface of the main body portion and spaced vertically upwardly and downwardly, respectively from the contact support 312. A keyway 313 is formed in the surface of the key boss 314 opposing the planar plate-like contact support 312. The main body portion 311 has a dowel or post 316 formed integrally with and protruding from the bottom surface thereof which is adapted to fit in an aperture formed in a printed-circuit board (not shown) to define the mounting position and a bottom plate section 317 extending forwardly from the main body portion 311 along the planar surface of the printed-circuit board below the key boss 315. The bottom plate section 317 and the key boss 315 are separated by a gap 317A and the bottom plate section 317 is formed with a through-aperture 318 extending to intersect with the gap 317A.

The planar plate-like contact support 312 is formed with juxtaposed contact accommodating grooves 312A corresponding in number to the narrow strip contacts 330 to be supported thereby and extending in the connector plugging-in/out direction. A narrow strip contact 330 is accommodated in each of the contact accommodating grooves 312A. Specifically, the narrow strip contacts 330 are inserted into the respective contact accommodating groove 312A from the rear end of the insulator body 310.

Figure 7:
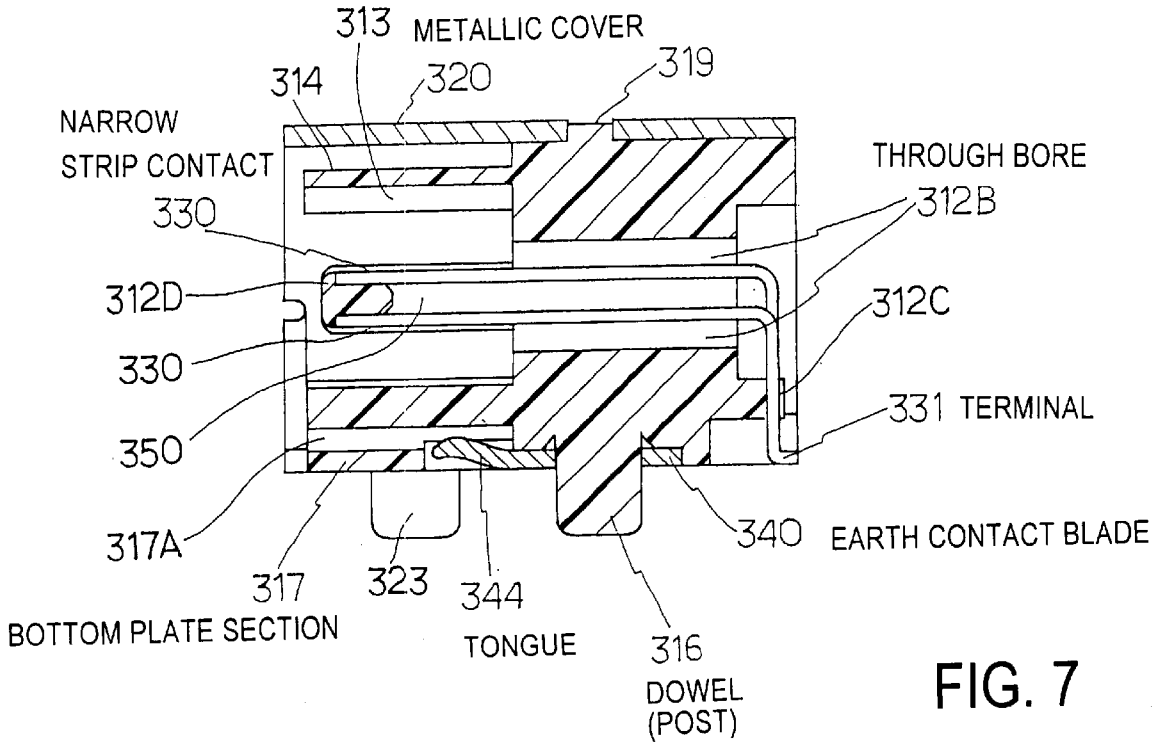
FIG. 7 is a cross-sectional view of the connector socket shown in FIG. 3.
Figure 8:
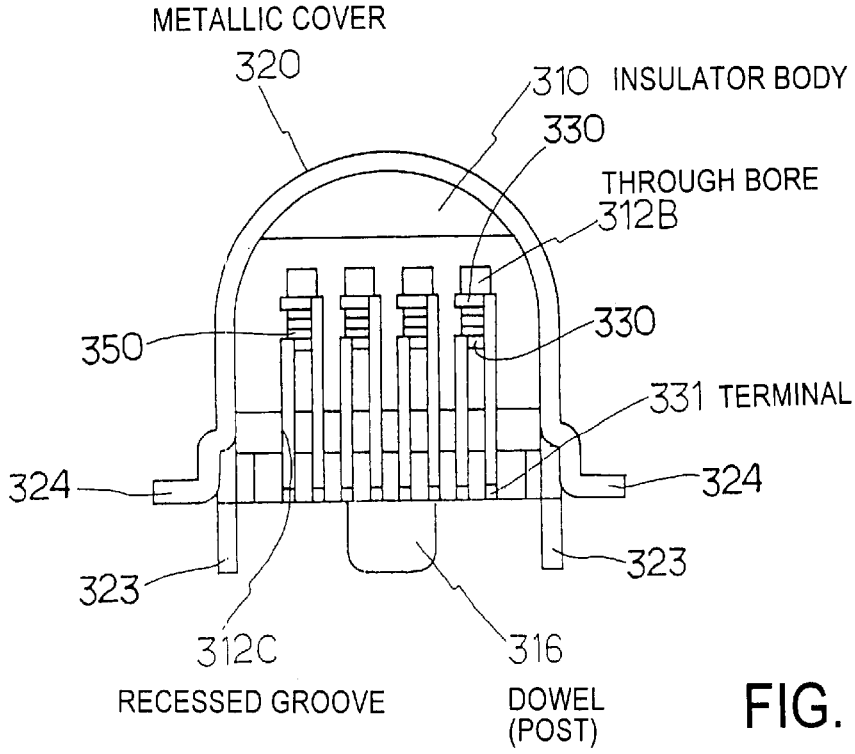
FIG. 8 is a rear view of the connector socket shown in FIG. 3.

In the illustrated embodiment, as shown in FIGS. 7 and 8, each narrow strip contact 330 is retained on its opposite side edges by the main body portion 311 while within the region of the planar plate-like contact support 312 only one side surface of the opposite side edges of the narrow strip contact 330 is in contact with the contact accommodating groove 312A without the intermediate portion of the contact 330 touching either the main body portion 311 or the planar plate-like contact support 312 such that a space 350 is defined between the opposed side surfaces of two vertically adjoining narrow strip contacts 330 so as to facilitate smooth insertion of the narrow strip contacts 330 into the contact accommodating grooves 312A. Those portions of the main body portion through which the contact accommodating grooves 312A are formed with through bores 312B in juxtaposition with the respective contact accommodating grooves 312A as shown in FIG. 5. The through bores 312B (see FIGS. 5 and 7) are intended to provide reinforcement of the molding tool for forming the contact accommodating grooves 312A since the tool is narrow and yet thin. The planar plate-like contact support 312 is further formed at its front end with outer protrusions 312D against which the forward ends of the narrow strip contacts 330 are to abut. The spaces 350 are also used to provide reinforcement of the molding tool.

As shown in FIG. 7, one lateral side portions of the narrow strip contacts 330 accommodated in the contact accommodating grooves 312A are folded at the rear end of the insulator body 310 in the direction of protrusion of the dowel 316, that is downwardly and extend through recessed grooves 312C (see FIGS. 5 and 8) and is further bent on the mounting surface of the printed-circuit board so as to extend along the mounting surface, ending in terminals 331. That is, the terminals 331 are shaped to be suitable for surface-mounting. It is seen in FIG. 8 that the narrow strip contacts 330 positioned on the opposite sides of the planar plate-like contact support 312 have their terminals 331 extending from the lateral sides opposite to each other so as to prevent the terminals 331 from contacting each other.

Figure 9:
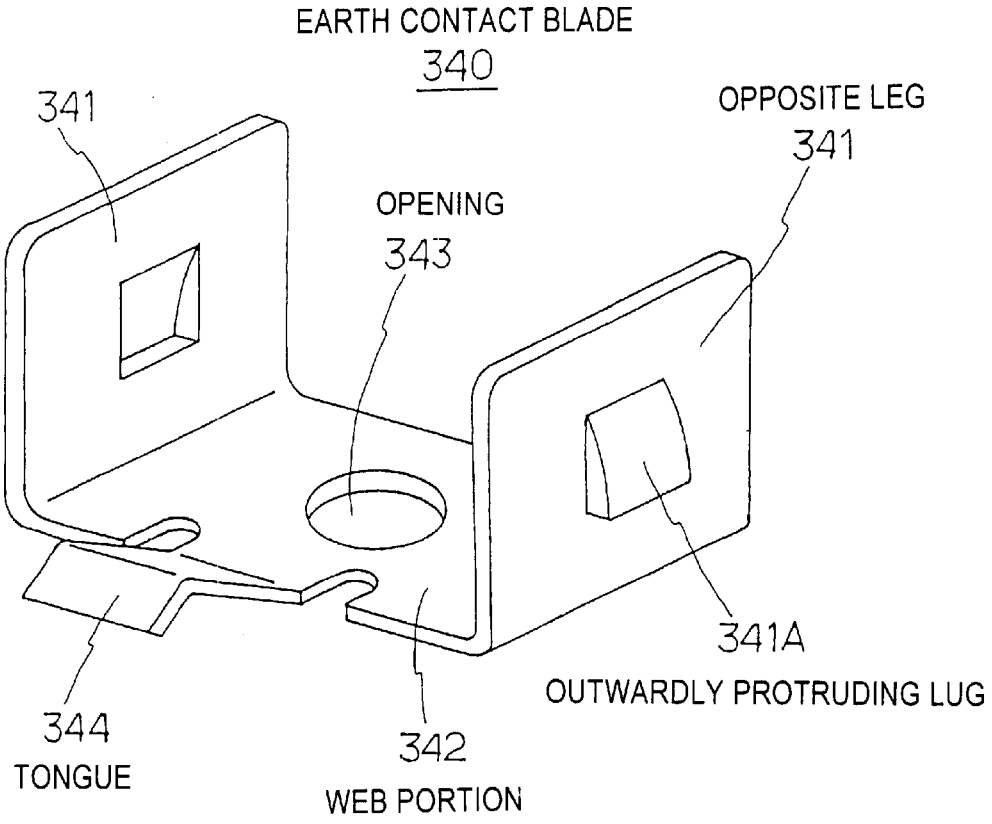
FIG. 9 is a perspective view illustrating one embodiment of the earth contact blade 340 for use with the connector socket according to this invention.

The earth contact blade 340 in FIG. 7 is shown in details in FIG. 9. The earth contact blade 340 is made from a metal sheet by folding it in the shape of U with the opposite legs 341 of the U-shaped blade extending alongside the opposite side surfaces of the insulator body 310 in contact with the inner wall of the metallic cover 320. The metallic cover 320 is formed through its opposite side walls with cutout apertures 321 as shown in FIG. 3 which are adapted to be engaged by outwardly protruding lugs 341A to secure the metallic cover 320 and the earth contact blade 340 together to form a subassembly which is in turn affixed to the insulator body 310.

The earth contact blade 340 is positioned such that the web portion 342 of the blade connecting the opposite legs 341 extends along the bottom surface of the insulator body 310. The web portion 342 is formed with an opening 343 into and through which the dowel 316 depending from the bottom surface of the insulator body 310 is press-fitted to secure the earth contact blade 340 to the insulator body 310. The web portion 342 has a tongue 344 extending from its front end. The tongue 344 is bent upwardly and extends through the through-aperture 318 formed in the bottom plate section 317, terminating in a further bent forward end which is inserted in the gap 317A (see FIG. 5) defined between the bottom plate section 317 and the key boss 315. The entire gap 317A forms a part of the annular groove 301 as is apparent from FIG. 3 another part of which is defined between the upper key boss 314 and the metallic cover 320. The annular groove 301 is adapted to receive the tubular metallic cover 420 of the connector plug 400. When the tubular metallic cover 420 of the connector plug 400 is inserted into the annular groove 301 including the gap 317A as will be described hereinafter, the metallic cover 420 comes into contact with the tongue 344 to establish connection between a ground circuit on the side of the plug 400 and a ground circuit on the side of the connector socket 300.

The main body portion 311 of the insulator body 310 has a protrusion 319 (FIG. 5) extending from its top surface which is engageable with a cutout aperture 322 formed through the top wall of the metallic cover 320 as shown in FIG. 3 to thereby to prevent axial relative movement between the metallic cover 320 and the insulator body 310.

The metallic cover 320 has tabs 323 and 324 extending from the lower end of each of the opposite side walls adjacent its front and rear ends, respectively for the propose of ensure more secure mounting of the cover onto the printed-circuit board. More specifically, in the illustrated example, the tabs 323 formed toward the front end of the metallic cover 320 are adapted to be inserted in and be soldered to corresponding apertures formed in the printed-circuit board while the tabs 324 formed toward the rear end are so bent as to extend along the planar surface of the printed-circuit board and is adapted to be soldered directly onto a conductor pattern formed on the printed-circuit board.

Connector Plug

The embodiment shown in FIG. 4 illustrates an instance in which resilient or spring contacts 430 are mounted on the connector plug 400. Specifically, the connector plug 400 according to this embodiment comprises an insulator body 410 covered around its outer periphery with a tubular metallic cover 420, and resilient contacts 430 mounted on the insulator body 410. The rearward portion of the metallic cover 420 is surrounded by an insulation cover 440.

Figure 10:
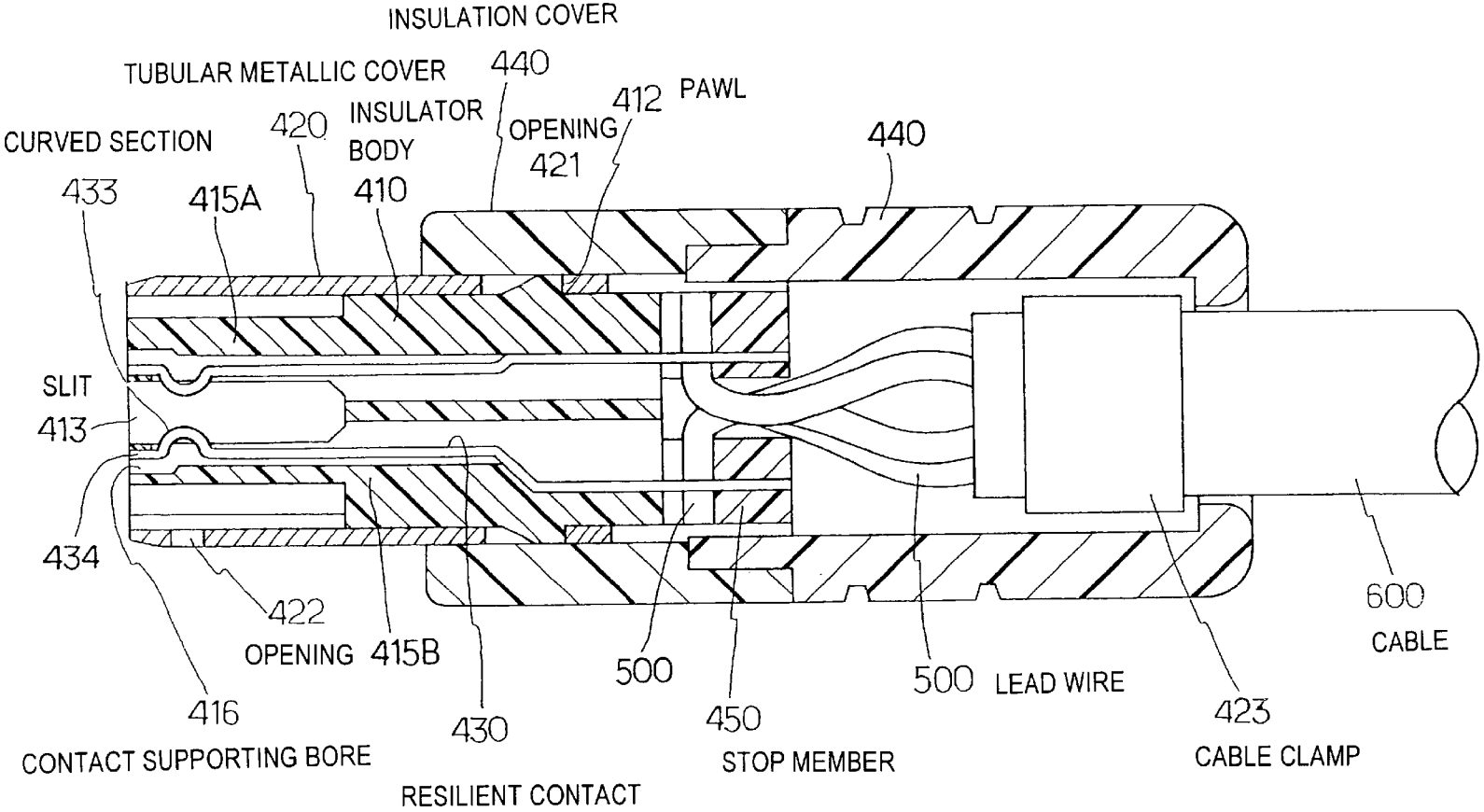
FIG. 10 is a cross-sectional view illustrating the internal construction of the connector plug shown in FIG. 4.
Figure 11:
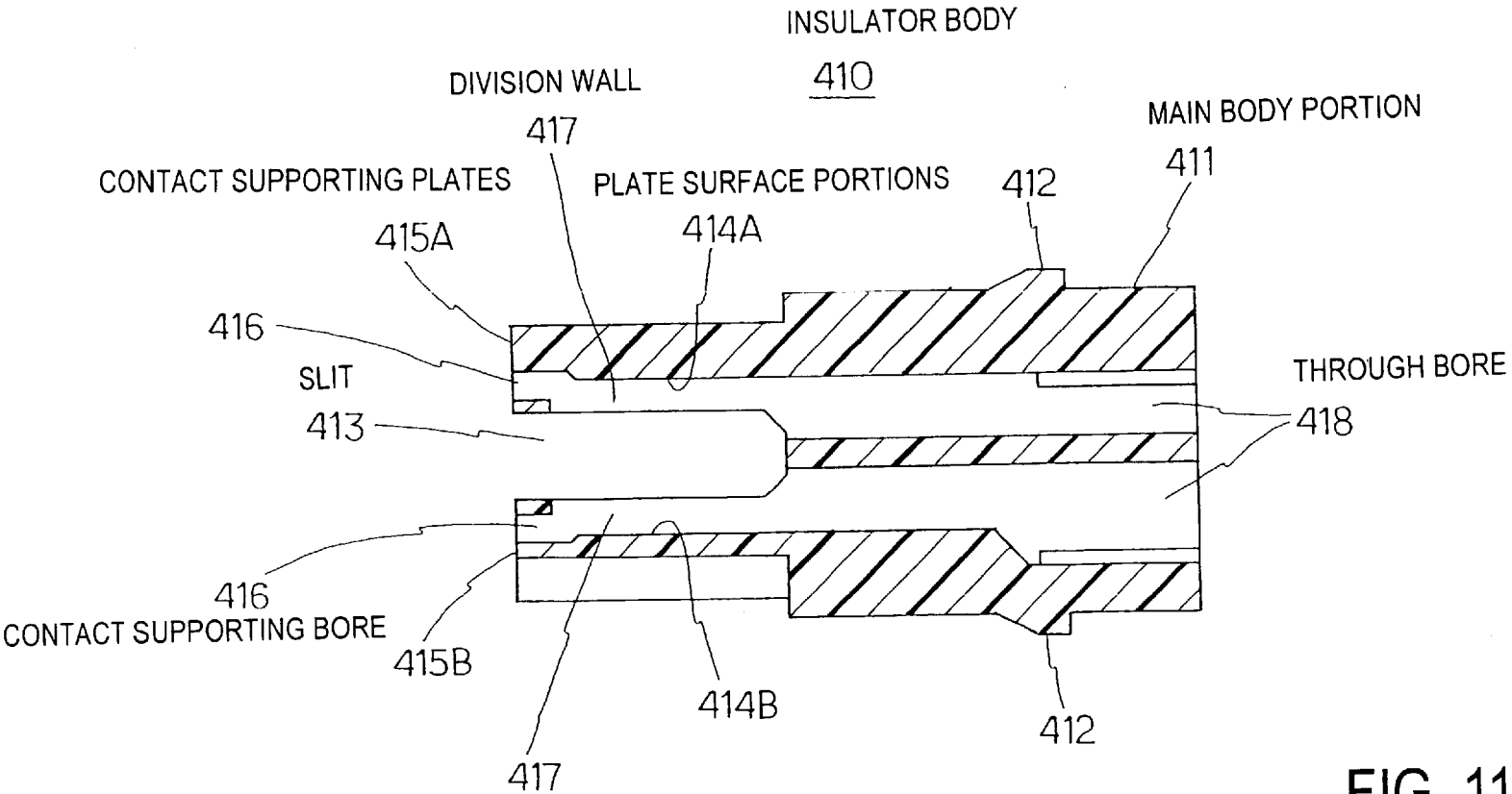
FIG. 11 is a cross-sectional view illustrating an insulator body 410 for use with the connector plug shown in FIG. 4.

FIG. 10 shows a cross-sectional view of the connector plug 400 according to this embodiment while FIG. 11 illustrates the insulator body 410 in a cross-sectional view. The insulator body 410 includes a columnar rear end portion which comprises a main body portion 411 fitted in and fixed to the rear end portion of the metallic cover 420. Specifically, pawls 412 formed around the outer periphery of main body portion 411 are adapted to engage in openings 421 formed in the metallic cover 420 (see FIG. 10) to prevent withdrawal of the body.

The insulator body 410 has a slit 413 formed in its front end face to define spaced apart contact supporting plates 415A and 415B having opposed plate surface portions 414A and 414B, respectively. The contact supporting plates 415A and 415B have front end faces flush with the front end face of the metallic cover 420 and have contact supporting bores 416 formed in their front end faces corresponding in number to the resilient contacts 430 to be supported. The illustrated embodiment shows an example in which each of the contact supporting plates 415A and 415B have four resilient contacts 430 supported thereby. Accordingly, in this example, each of the contact supporting plates 415A and 415B have four contact supporting bores 416 formed in its front end face (see FIG. 4).

Formed in the plate surface portions 414A and 414B are contact accommodating recessed grooves communicating with the respective contact supporting bores 416 and having a slightly larger width than that of the resilient contacts 430. Adjacent contact accommodating recessed grooves are separated from each other by division walls 417 as shown in FIG. 11. Continuing from the contact accommodating recessed grooves are through bores 418 formed in the main body portion 411. The through bores 418 are adapted to engage detents 431 formed on the resilient contacts 430 as shown in FIG. 12 to prevent axial withdrawal of the latter.

The resilient contacts 430 are formed in their rear end portions with elongated slits 432 each having opposed slant surfaces 432A converging toward each other forwardly from the rear ends. The elongated slits 432 are designed to provide for so-called solderless or crimping connection between the resilient contacts 430 and lead wires 500 (see FIG. 10). Specifically, the lead wire 500 with insulating coating thereon is inserted transversely into the elongated slit 432 at its rear enlarged end, and then applying pressure on the lead wire 500 from rearward via a stop member 450 which will be described hereinafter causes the coating of the lead wire 500 to be torn by the slant surfaces 432A as the wire is pushed forwardly through the elongated slit 432 to expose the core of the wire and bring it into contact with the resilient contact 430. This method of connection is commonly called solderless connection or crimp contact. The use of this method of connection provides an advantage of reducing the volume required for the connection between the contact and lead wire. The resilient contacts 430 terminate in forward tips or forward end portions 434 which are received in the contact supporting bores 416 (FIG. 10) and include curved sections 433 adjoining rearwardly to the tips 434.

Figure 12:
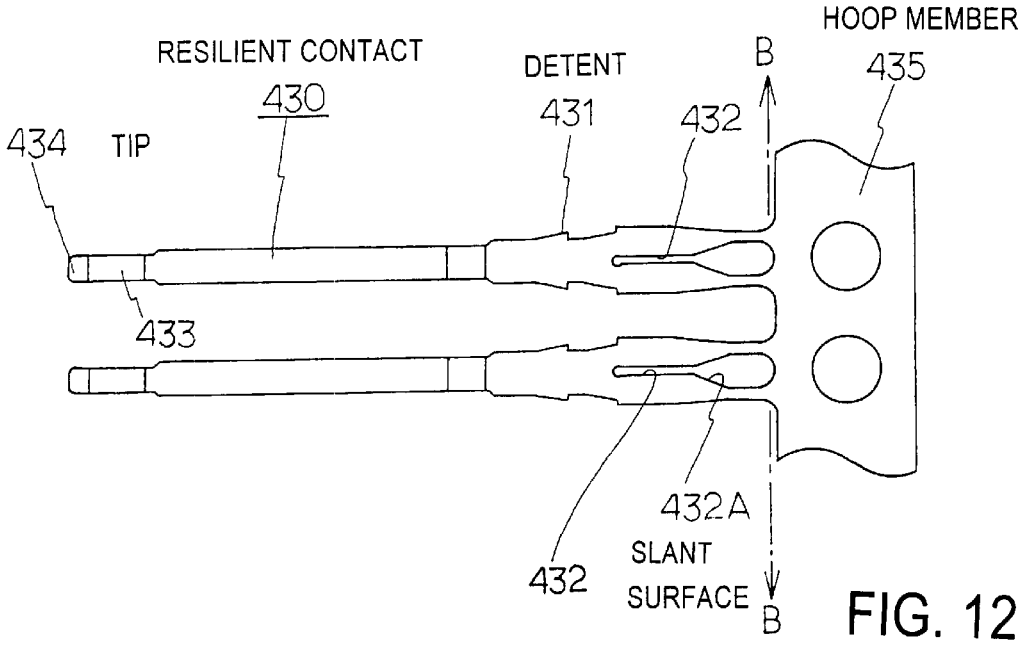
FIG. 12 is a plan view illustrating a resilient contact for use with the connector plug shown in FIG. 4.
Figure 13:
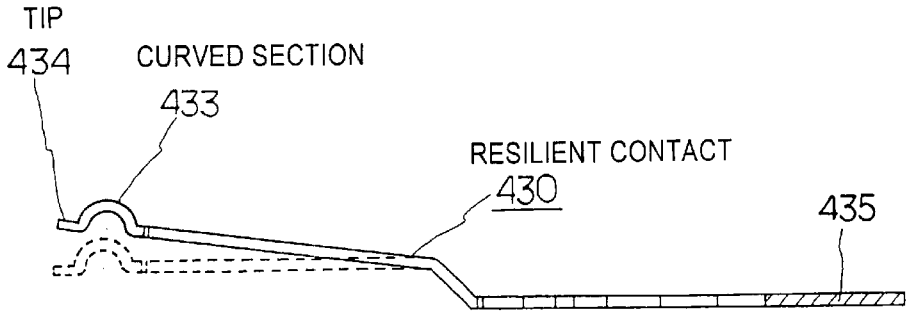
FIG. 13 is a side view of FIG. 12.

It is to be noted that the resilient contact 430 shown in FIGS. 12 and 13 are designed to be mounted in the lower contact supporting plate 415B shown in FIG. 10. It is also to be noted that the resilient contact 430 to be mounted in the upper contact supporting plate 415A is identical to that depicted in FIGS. 12 and 13 with respect to the connection with the lead wire, the curved section 433 and tips 434 except that the bent section of the contact 430 intermediate the opposite ends thereof is shallower in the amount of bend than that of the contact depicted in FIGS. 12 and 13, as seen in FIG. 10.

While the resilient contacts 430 are illustrated as being supported by a hoop member 435 in FIG. 12, it is to be understood that the hoop member 435 is ultimately severed off along the line B—B shown in FIG. 12.

Figure 14:
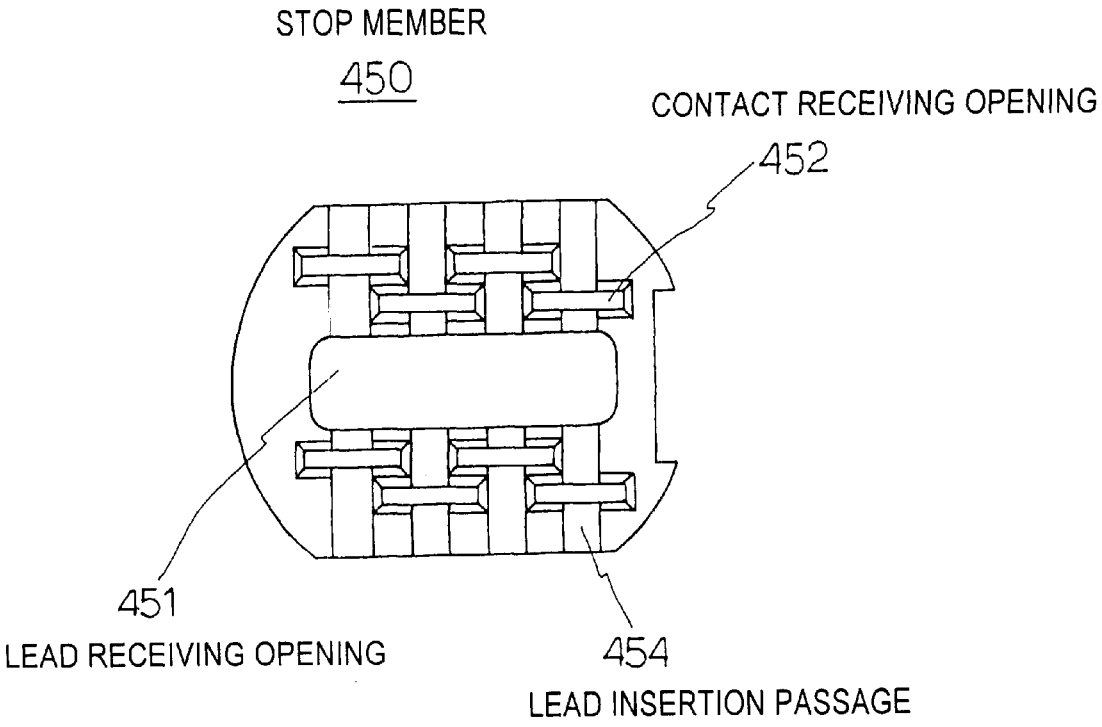
FIG. 14 is a front view illustrating the construction of a stop member for use with the connector plug shown in FIG. 4.
Figure 15:
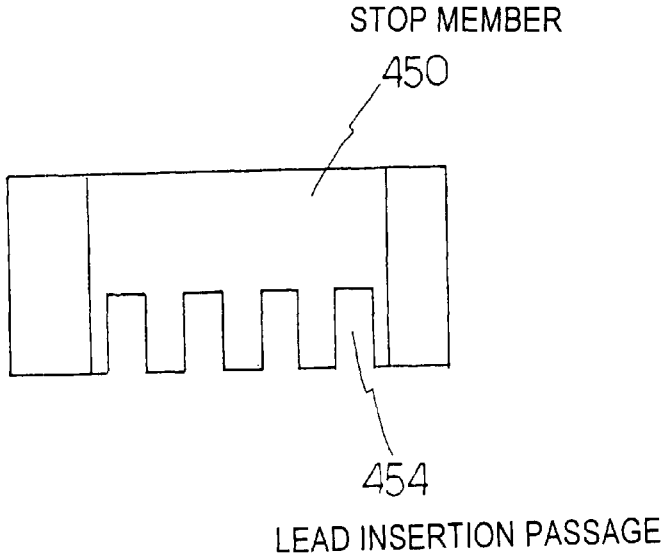
FIG. 15 is a plan view of FIG. 14.

FIG. 14 and FIG. 15 show a front end view and a plan view, respectively the stop member 450. The stop member 450 is formed of insulation material and has a lead receiving opening 451 for passing the lead wire 500 formed in the center thereof and contact receiving openings 452 for passing the resilient contacts 430 formed above and below the lead receiving opening 451. The stop member 450 is formed in its front end face with lead insertion passages 454 vertically extending and intersecting with the lead receiving opening 451 and the corresponding contact receiving openings 452. The stop member 450 with lead wires 500 carried in the respective lead insertion passages 454 is pressed against the rear end face of the insulator body 410 to crimp-connect the lead wires 500 with the resilient contacts 430.

Figure 16:
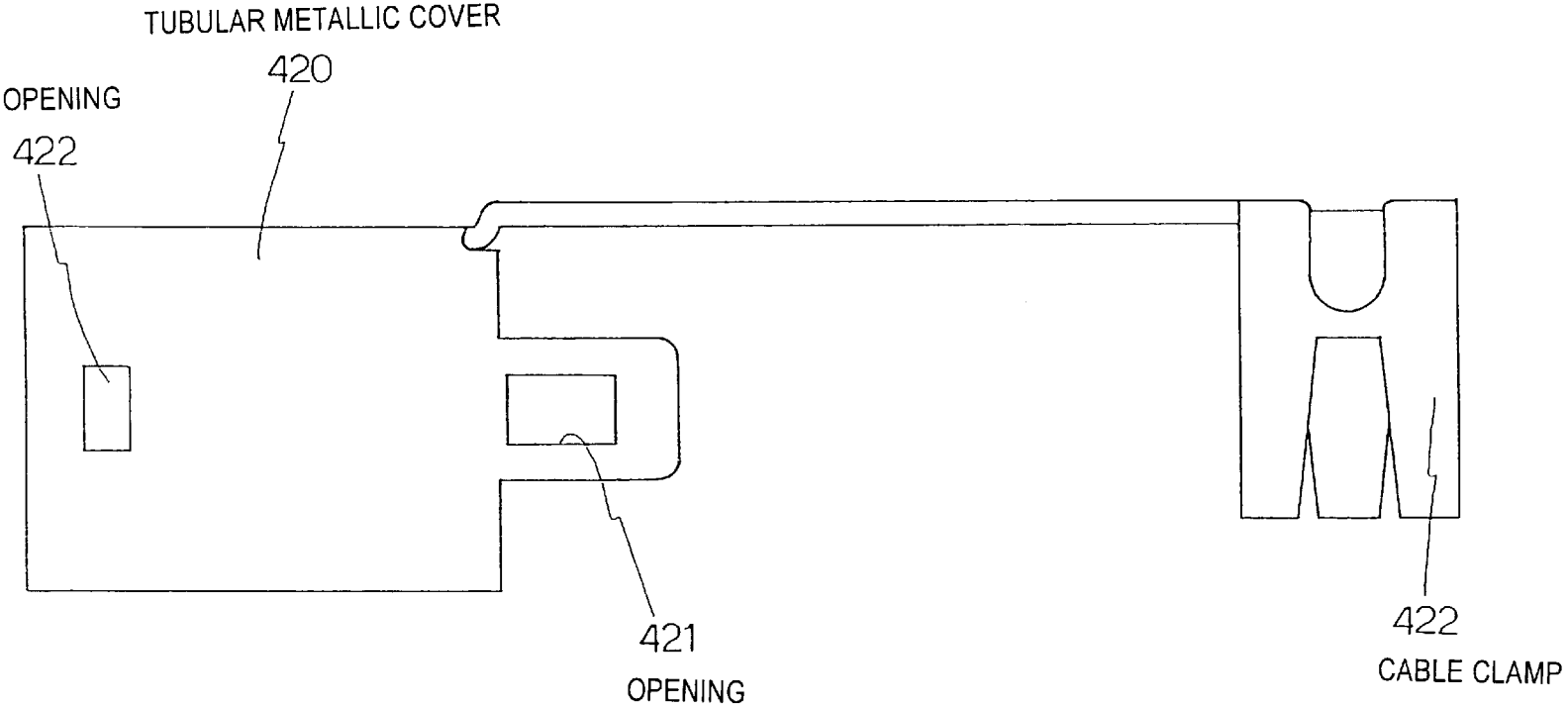
FIG. 16 is a bottom view illustrating a metallic cover used with the connector plug shown in FIG. 4.

As shown in FIG. 16, the metallic cover 420 has a cable clamp 422 extending from the rear end thereof for gripping a cable 600 (FIG. 10) composed of a bundle of the lead wires 500 so as to prevent tension from being transmitted to the lead wires 500.

Mounted to the periphery of the metallic cover 420 adjacent the rear end thereof is an insulation cover 440 for the purpose of protecting the portion of the cable 600 which extends out from the clamp.

As shown in FIGS. 10, 12 and 13, towards its forward end of the resilient contact 430 includes a curved section 433 and a tip 434 extending forwardly therefrom. The tip 434 is inserted and positioned in place in the contact supporting bore 416 and caught by the bore to be prevented from resiliently moving away from the plate surface portion 414A or 414B to maintain the attitude of the resilient contact 430 in spaced relation with the plate surface portion 414A or 414B. The resilient contacts 430 are mounted in such an orientation that the curved sections 433 protrude in the direction away from the plate surface portions 414A, 414B of the corresponding contact supporting plates 415A, 415B and that the curved sections 433 vertically oppose each other within the slit 413.

The upper contact supporting plate 415A has a key 419A extending from the top surface thereof while the lower contact supporting plate 415B has keyway 419B formed in its bottom surface, as shown in FIG. 4. The key 419A is adapted to mate with the keyway 313 of the connector socket 300 shown in FIG. 3 while the keyway 419B is adapted to mate with the key boss 315 of the connector socket 300, whereby erroneous coupling is prevented between wrong types of connector sockets and connector plugs.

The metallic cover 420 has an opening 422 (FIG. 10) formed through its side wall adjacent the front end thereof. The opening 422 is configured to be engaged by the tongue 344 shown in FIGS. 7 and 9 which in turn contacts the metallic cover 420 to establish electrical connection between the ground circuits on the connector plug 400 and the connector socket 300 as explained earlier. In addition, engagement between the tongue 344 with the opening 422 strengthens the coupling force of the connector plug 400 to the connector socket 300, so that an accidental dislodgement of the connector plug 400 under a small external force is avoided.

In use, the planar plate-like contact support 312 of the connector socket 300 is inserted into the slit 413 of the connector plug 400 so that the narrow strip contacts 330 carried by the planar plate-like contact support 312 are brought into contact with the curved sections 433 in the resilient contacts 430 to thereby electrically connect the connector side contacts on one hand and the plug side contacts on the other hand.

While in the embodiment illustrated in FIGS. 3 and 4 the connector socket 300 is provided with the key bosses 314, 315 and the keyway 313 and the connector plug 400 is provided with the key 419A and the keyway 419B in order to avoid wrong connection between connector sockets 300 and connector plugs 400 which are different with respect to the number and/or arrangement of the contacts or which have the same number and array of contacts, but are different types with respect to the applications such as audio and video uses, it will be appreciated that the locations of the keyway 313 and key 419A may be staggered in the direction of the array of contacts to correspond with different types of connectors, for example.

The other various examples of configurations for correspondence with different types of connectors are illustrated in FIGS. 17–24. In these figures, A and B indicate the front end faces of the connector socket and the connector plugs, respectively, and the components corresponding to those shown in FIGS. 3 and 4 are referenced with the like numerals.

Figure 17:
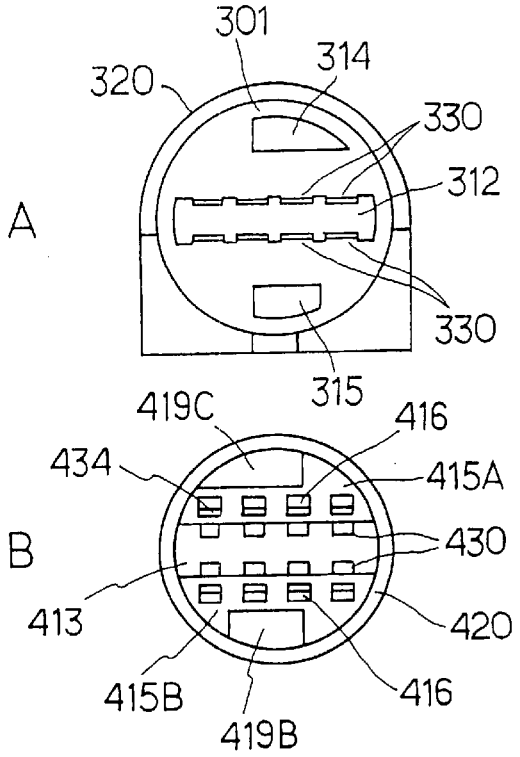
FIG. 17A is a front view illustrating another embodiment of the connector socket according to this invention.
FIG. 17B is a front view illustrating an embodiment of the connector plug according to this invention for coupling with this connector socket.
Figure 18:
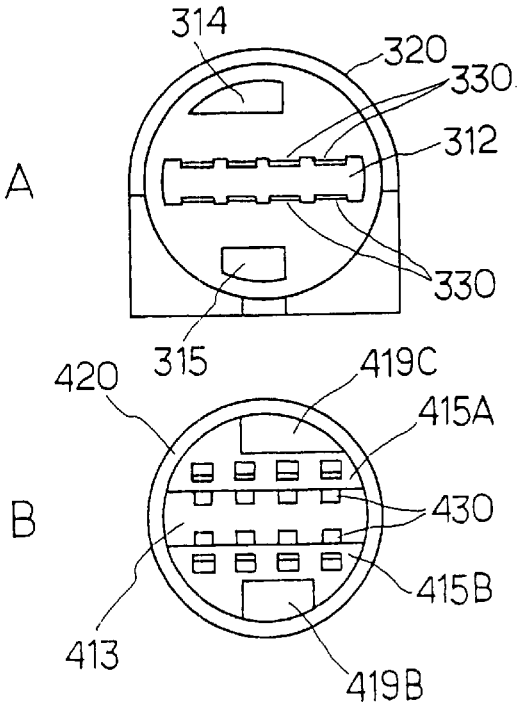
FIG. 18A is a front view illustrating yet another embodiment of the connector socket according to this invention.
FIG. 18B is a front view illustrating an embodiment of the connector plug according to this invention for coupling with this connector socket.

In the example of FIG. 17, the key boss 314 has the cross-sectional profile of a crescent moon with its one end portion cutoff and with the keyway 313 eliminated, and the key boss 315 is also configured to have its left hand end portion removed as seen in FIG. 17A. The example of FIG. 18 is similar to that of FIG. 17 except that the key boss 314 and the key boss 315 are located symmetrically about the vertical center line with respect to the arrangement in FIG. 17.

Figure 19:
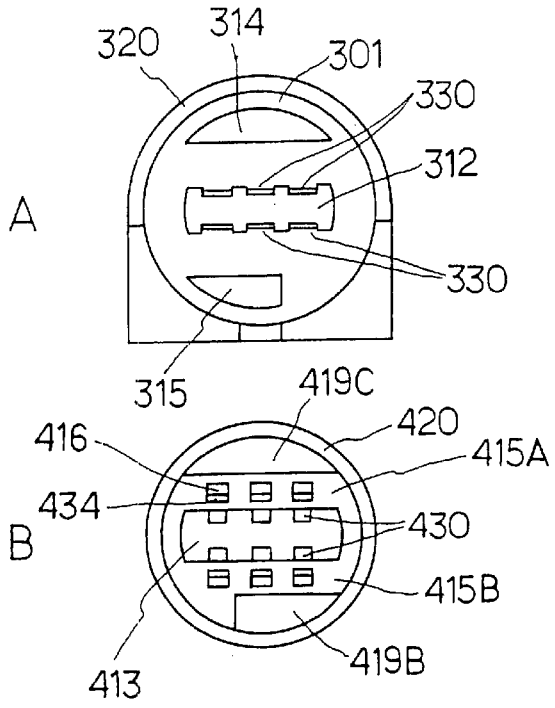
FIG. 19A is a front view illustrating still another embodiment of the connector socket according to this invention.
FIG. 19B is a front view illustrating an embodiment of the connector plug according to this invention for coupling with this connector socket.
Figure 20:
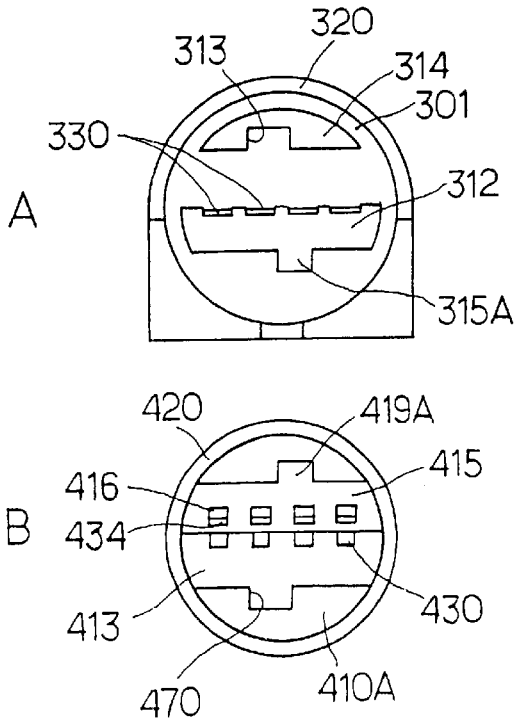
FIG. 20A is a front view illustrating an embodiment of the connector socket according to this invention having contacts disposed on one side surface of a support and FIG. 20B is a front view illustrating a connector plug according to this invention for coupling with this connector socket.

FIG. 19 illustrates an example in which the key boss 314 is different from that shown in FIG. 3 in that it has the keyway 313 eliminated therefrom and in which the key boss 315 is configured to have a cross-sectional profile of a crescent moon with its one end portion cutoff. This example also shows an instance in which three narrow strip contacts 330 are provided on each of the opposed side surfaces of the planar plate-like contact support 312 whereby the width of the planar plate-like contact support 312 is reduced. Correspondingly with the reduction in width of the contact support 312, the contact supporting plates 415A and 415B 415A in the connector plug are integrally connected together at their opposite ends so that the planar plate-like contact support 312 is generally fitted in the slit 413.

Figure 21:
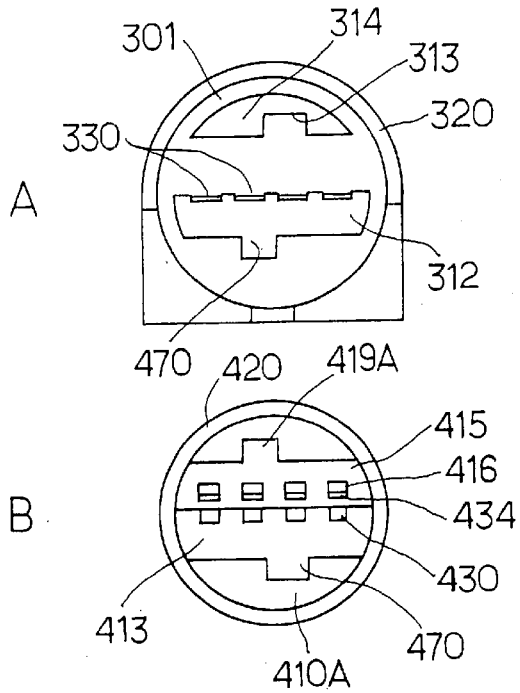
FIG. 21A is a front view illustrating an embodiment of the connector socket according to this invention having contacts disposed on one side surface of a support and FIG. 21B is a front view illustrating a connector plug according to this invention for coupling with this connector socket.

FIGS. 20–24 illustrates examples in which for three or four narrow strip contacts 330 provided, the planar plate-like contact support 312 in the connector socket is offset vertically with respect to the center. FIG. 20A shows an instance in which the key boss 314 including the keyway 313 is construction similar to that shown in FIG. 3, but with the keyway 313 offset to the left from the center as viewed in FIG. 3. In addition, the planar plate-like contact support 312 is displaced downwardly, the lower key boss 315 is eliminated, and a key 315A is formed on the lower surface of the planar plate-like contact support 312 in a transversely offset position. Correspondingly with this, the insulator body 410 in the connector plug has a lower extension 410A extending along the metallic cover 420 upto its forward end, and the extension 410A has a keyway 470 formed in the surface thereof opposing contact supporting plate 415 which is adapted to fittingly receive the key 315A. FIG. 21 illustrates an example similar to that shown in FIG. 20, but having an mirror image of the keyway 313 and key 315A.

Figure 22:
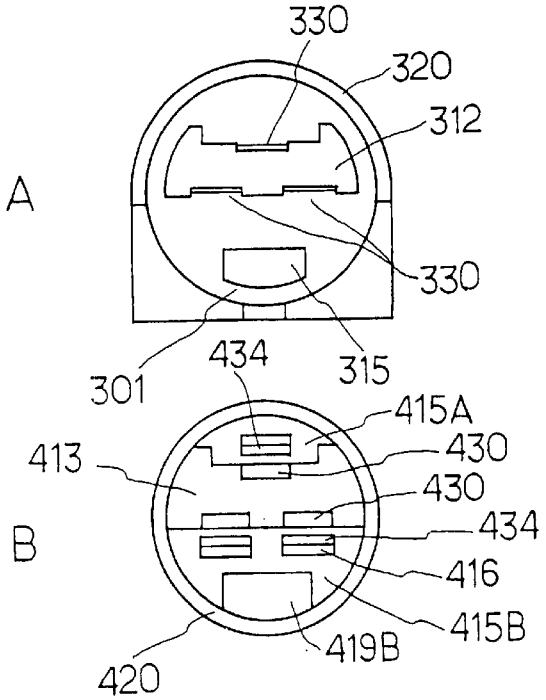
FIG. 22A is a front view illustrating an embodiment of the connector socket according to this invention having the support eccentrically positioned.
FIG. 22B is a front view illustrating an embodiment of the connector plug according to this invention for coupling with this connector socket.
Figure 23:
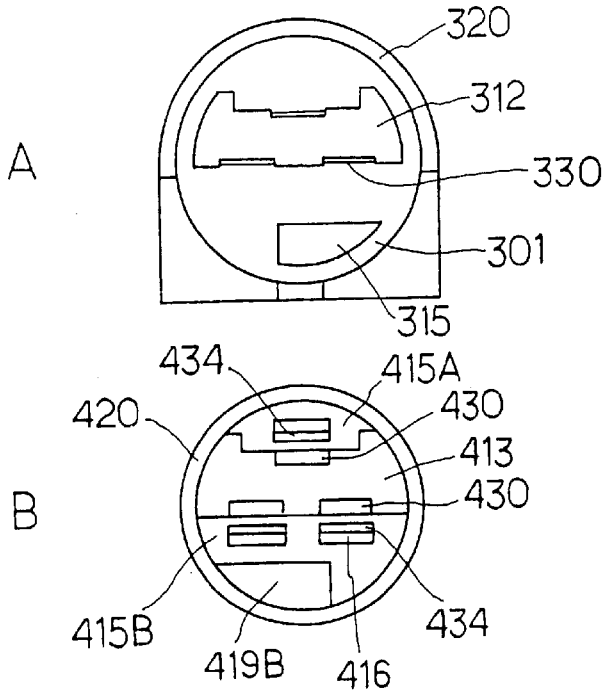
FIG. 23A is a front view illustrating another embodiment of the connector socket according to this invention having the support eccentrically positioned.
FIG. 23B is a front view illustrating an embodiment of the connector plug according to this invention for coupling with this connector socket.
Figure 24:
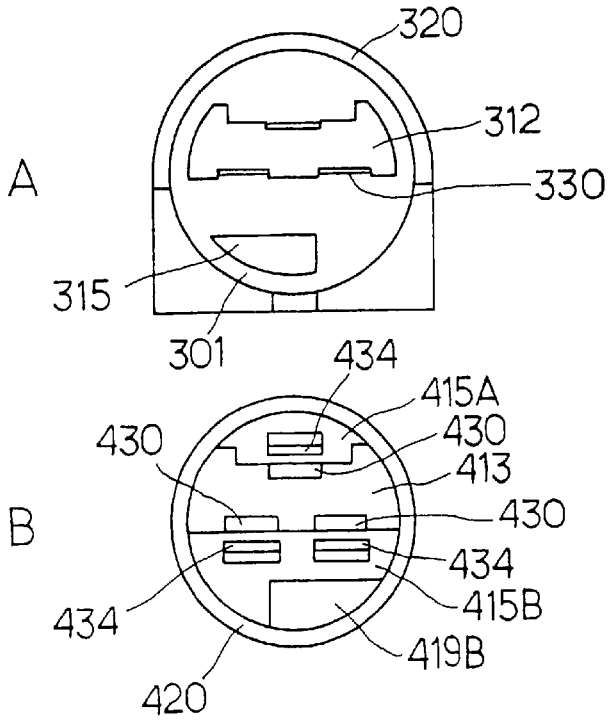
FIG. 24A is a front view illustrating yet another embodiment of the connector socket according to this invention having the support eccentrically positioned.
FIG. 24B is a front view illustrating an embodiment of the connector plug according to this invention for coupling with this connector socket.

In the example of FIG. 22, the planar plate-like contact support 312 is offset vertically upwardly, the upper key boss 314 is eliminated, and a key boss 315 is disposed in the lower portion. One and three narrow strip contacts 330 are provided on the upper and lower side surfaces, respectively of the planar plate-like contact support 312. The examples of FIGS. 23 and 24 are similar in arrangement to that FIG. 22, but are distinguished from each other by the shape and location of the key boss 315.

In any of the examples of FIGS. 17–24, the key boss 314 and/or 315 have surfaces extending alongside the annular groove 301 and define part of the annular groove. That is, the opposite lateral side surfaces of the key boss 314 and/or 315 and of the planar plate-like contact support 312 define part of the annular groove 301.

Figure 25:
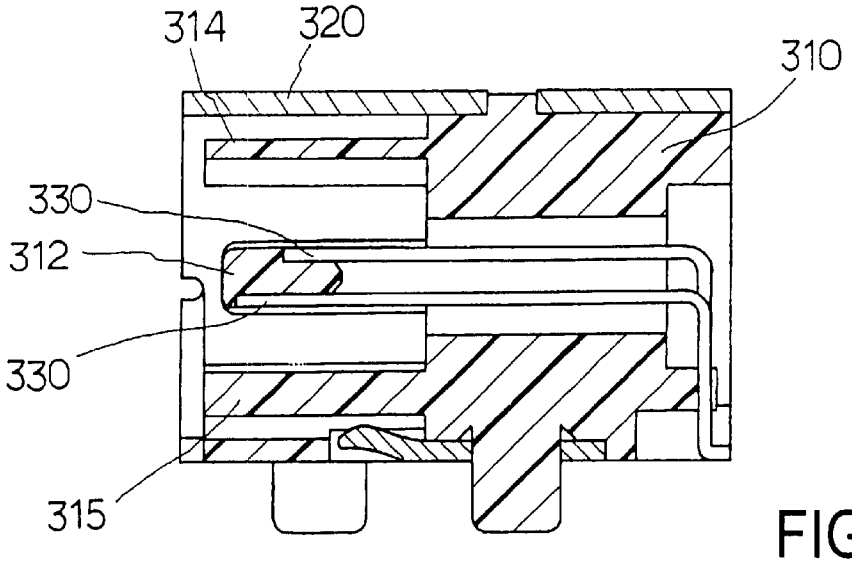
FIG. 25 is a cross-sectional view illustrating another embodiment of the connector socket according to this invention.

In an instance in which the forward ends of the narrow strip contacts 330 in the connector socket are staggered as shown in FIG. 25, for example in which the forward end of the upper narrow strip contact is recessed rearwardly from that of the lower narrow strip contact, the arrangement may be such that whenever the connector socket is coupled to the connector plug, a contact associated with a certain signal (or grounding) line is always connected with the contact in the plug prior to the contacts for the other signal lines being connected with the corresponding contacts.

In an alternate embodiment, the metallic cover 320 of the connector socket may be configured to have a flat top surface 320A toward the rear end thereof, so that during automated assembly operation, the metallic cover 320 may be picked up and carried for assembly by an appropriate vacuum-attracting device.

Figure 26:
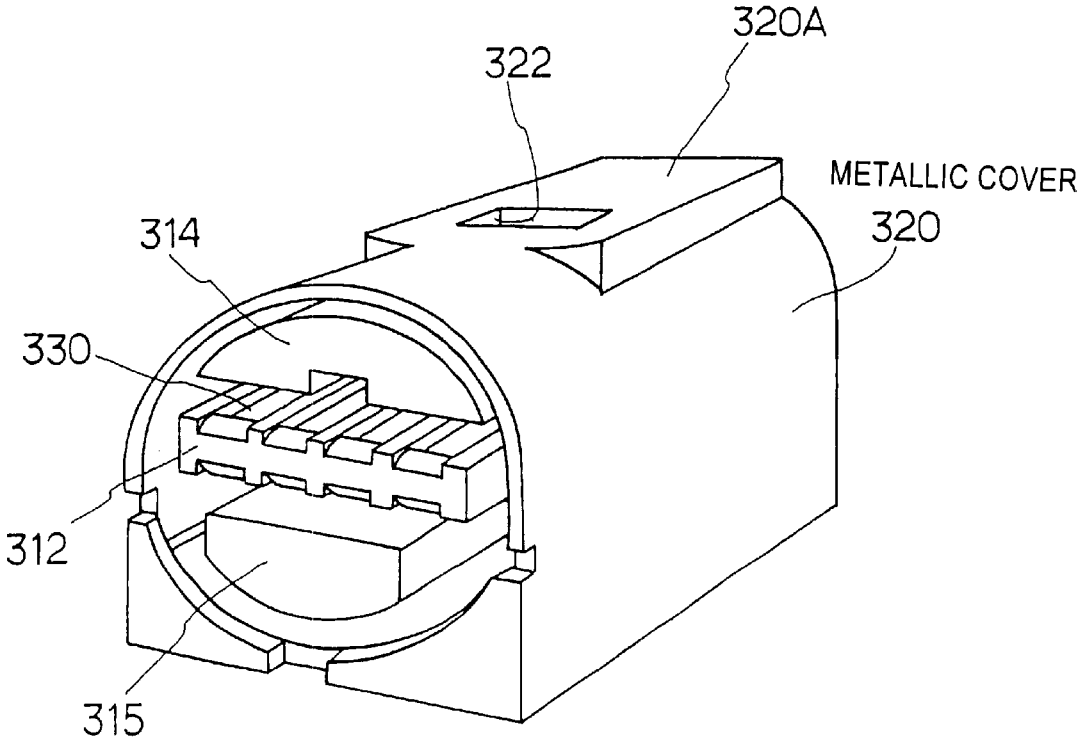
FIG. 26 is a perspective view illustrating the other embodiment of the connector socket according to this invention.
Figure 27:
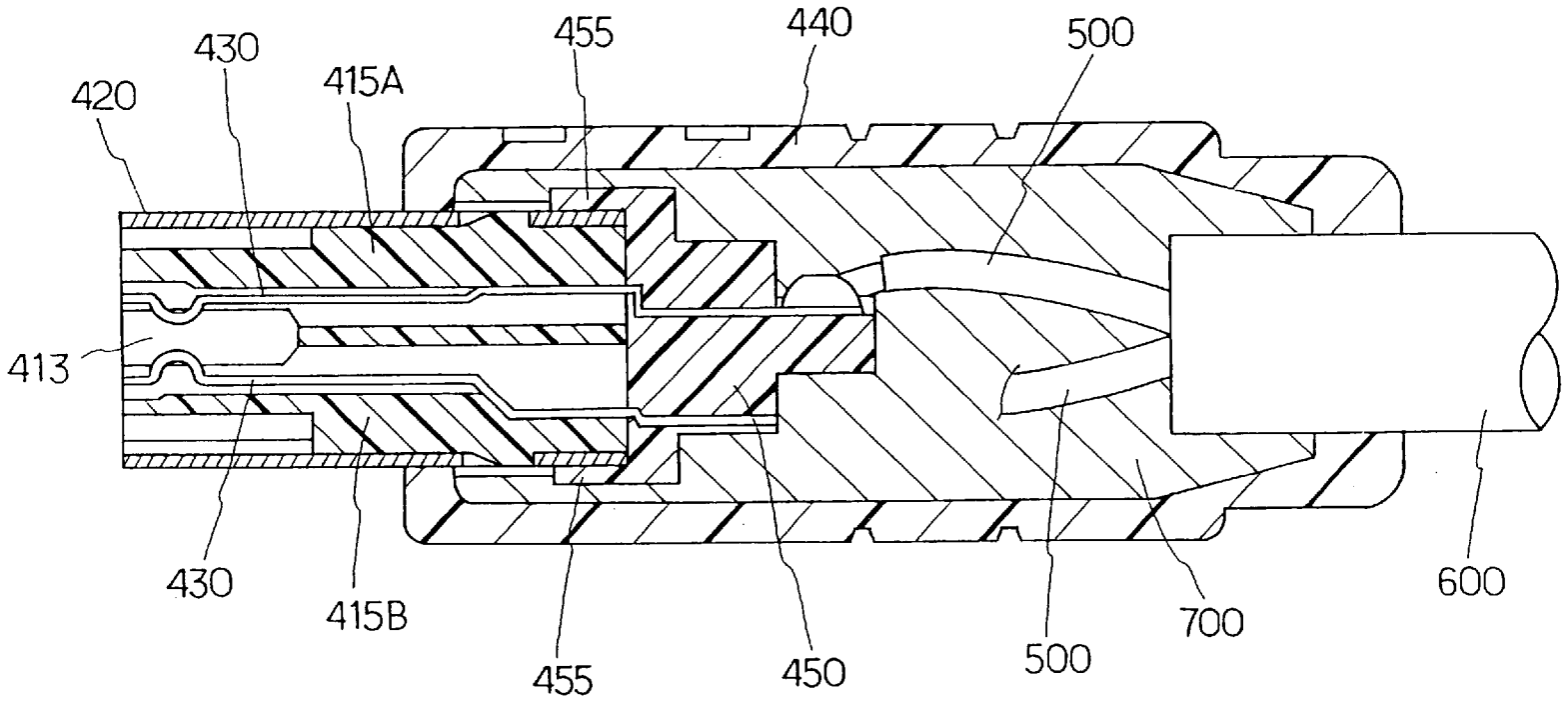
FIG. 27 is a cross-sectional view illustrating another embodiment of the connector plug according to this invention.
Figure 28:
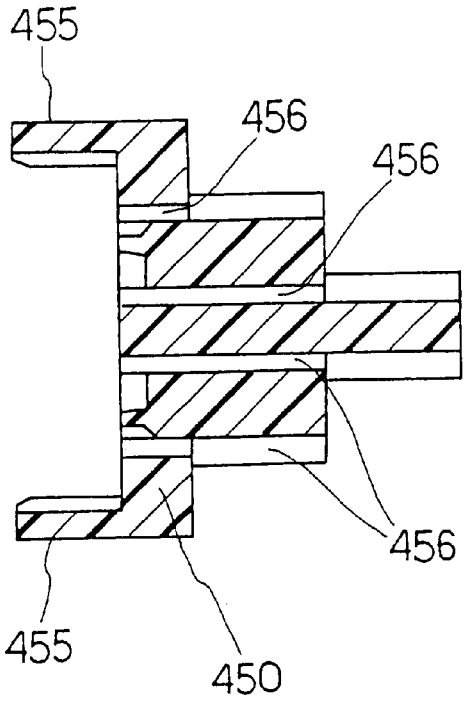
FIG. 28 is a cross-sectional view of the stop member 450 in FIG. 27.

In a modified form of the stop member 450 for the connector plug, it may have forwardly projecting arms 455 and be mounted in abutment against the rear end face of the insulator body 410 with the arms 455 grasping the outer periphery of the insulator body therebetween, as shown in FIGS. 26 and 27. The rear end portions of contacts 430 are passed through contact insertion passages 456 and the forward ends of the lead wires 500 are soldered to the projecting rear ends of the contacts 430. Subsequently, a filler 700 of resinous material may be formed by insert-molding such that the rearward end portion of the metallic cover 420, the stop member 450 and a portion of the cable 600 are embedded in the filler. Further, the insulation cover 440 may also be insert-molded so as to cover the filler 700.

Figure 29:
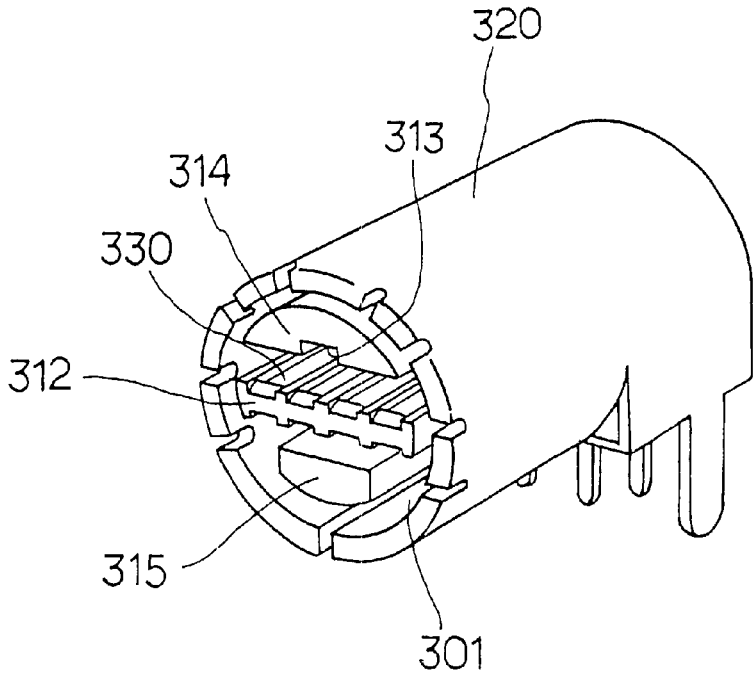
FIG. 29 is a perspective view illustrating an embodiment of the modified external appearance of the connector socket according to this invention.
Figure 30:
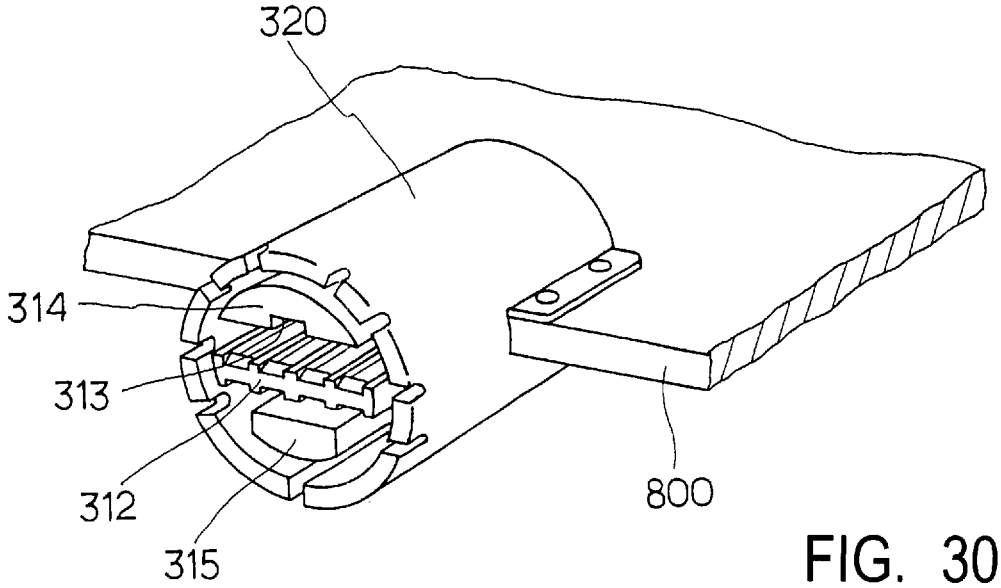
FIG. 30 is a perspective view illustrating the embodiment of the modified external appearance of the connector socket according to this invention being mounted on a wiring board.
Figure 31:
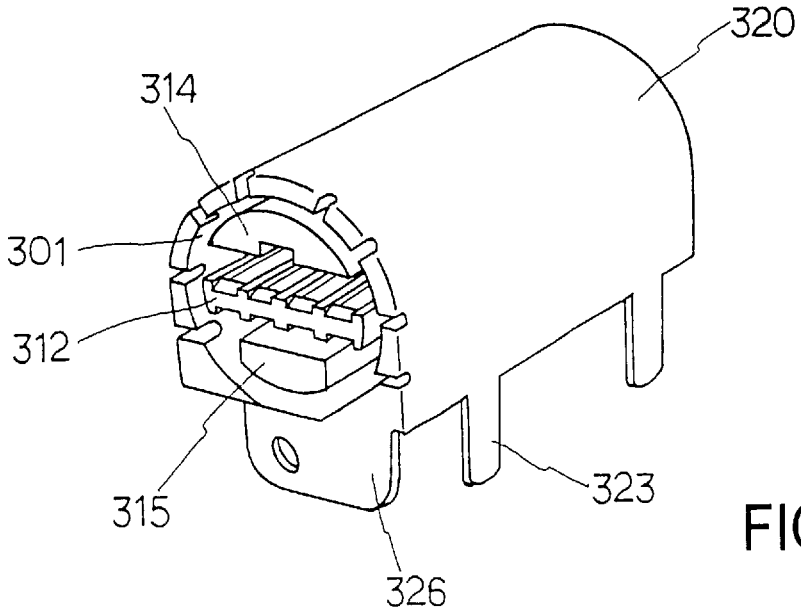
FIG. 31 is a perspective view illustrating an embodiment of the further modified external appearance of the connector socket according to this invention.

In an alternate form of the metallic cover 320, it may have a cylindrical forward portion and a semi-cylindrical rearward portion, as shown in FIG. 29. The semi-cylindrical rearward portion may be configured to form a mounting portion onto a wiring board. Alternatively, the entire metallic cover 320 may be cylindrical as shown in FIG. 30. In that case, the outer periphery of the cylindrical metallic cover 320 may be inserted in a cut-out formed in a wiring board 800 to be carried by the wiring board. In a still alternate form as shown in FIG. 31, the metallic cover 320 may be generally of a semi-cylindrical shape and have an attachment tab 326 which is formed by an extension extending from one side of the forward end of the cover which is folded at substantially right angles to have the free end of the extension reach the other side of the forward end of the cover so that an annular groove 301 is defined partly by the attachment tab 326 and the forward end of the semi-cylindrical metallic cover 320, and the bottom surface of the insulator body 310 may be shaped so as to define a part of the circumference of a circle. In the embodiments of FIGS. 29–31, the planar plate-like contact support 312, the key bosses and others may have any one of the various configurations illustrated in FIGS. 17–24.

Figure 32:
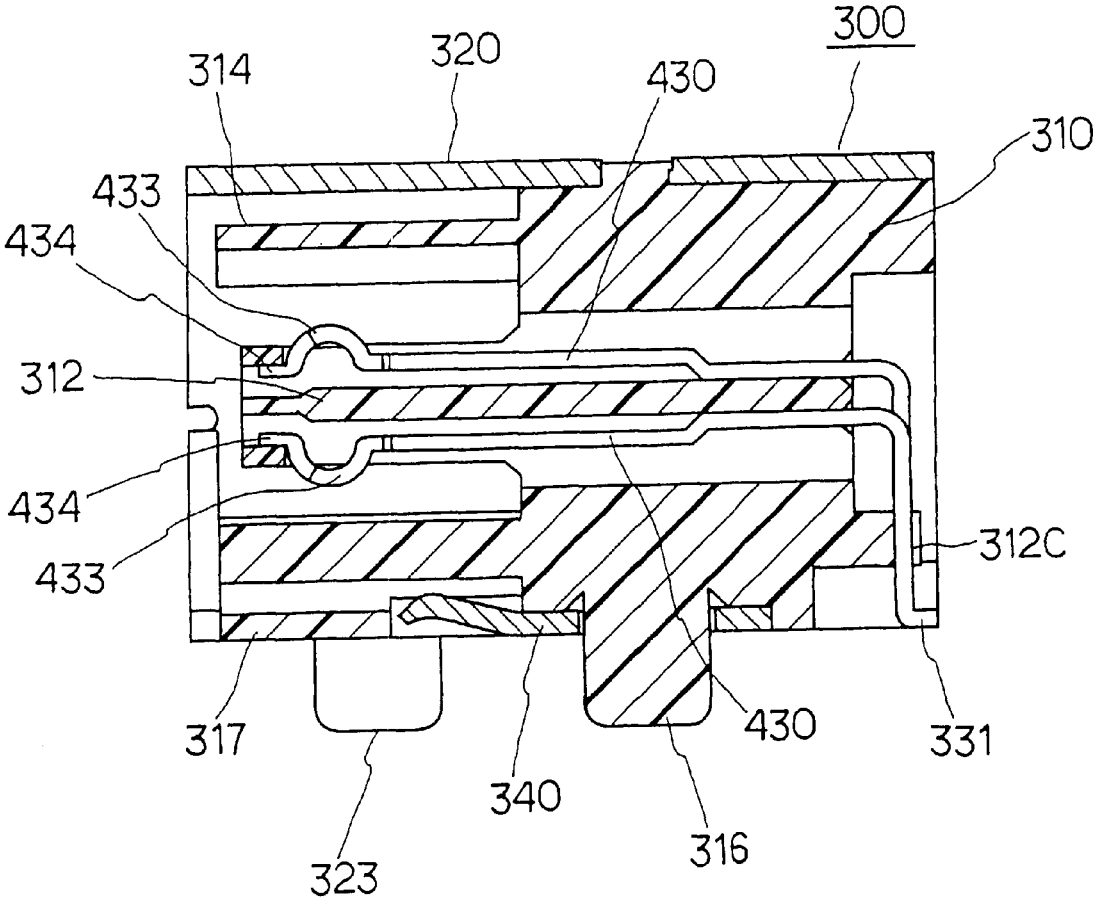
FIG. 32 is a cross-sectional view illustrating an embodiment of the connector socket according to this invention having resilient contacts.

By way of example, as illustrated in FIG. 32, the narrow strip contacts 330 may be replaced by the resilient contacts 430 as shown in FIGS. 12 and 13. In this case, by the same technique as that for mounting the resilient contacts 430 to the connector plug, contact accommodating grooves are formed in the opposite side surfaces, in this example, of the planar plate-like contact support 312. The resilient contacts 430 are fitted in the respective contact accommodating grooves and resiliently urged or biased away from the planar plate-like contact support 312. However, the tips 434 of the resilient contacts 430 are inserted and engaged by engagement bores formed at the forward ends of contact accommodating grooves so that the resilient contacts 430 are prevented from resiliently moving away from the planar plate-like contact support 312 to maintain a spacing between the bottom surfaces of the contact accommodating grooves and the resilient contacts 430. The rear end portions of the resilient contacts 430 are in contact with the bottom surfaces of the contact accommodating grooves where the anti-withdrawal detents 431 (FIG. 12) of the resilient contacts 430 are forced in and retained by the contact accommodating grooves. The further rearward end portions of the resilient contacts 430 are bent downwardly at substantially right angles, ending in terminals 331 as is the case with the embodiment shown in FIG. 7.

Figure 33:
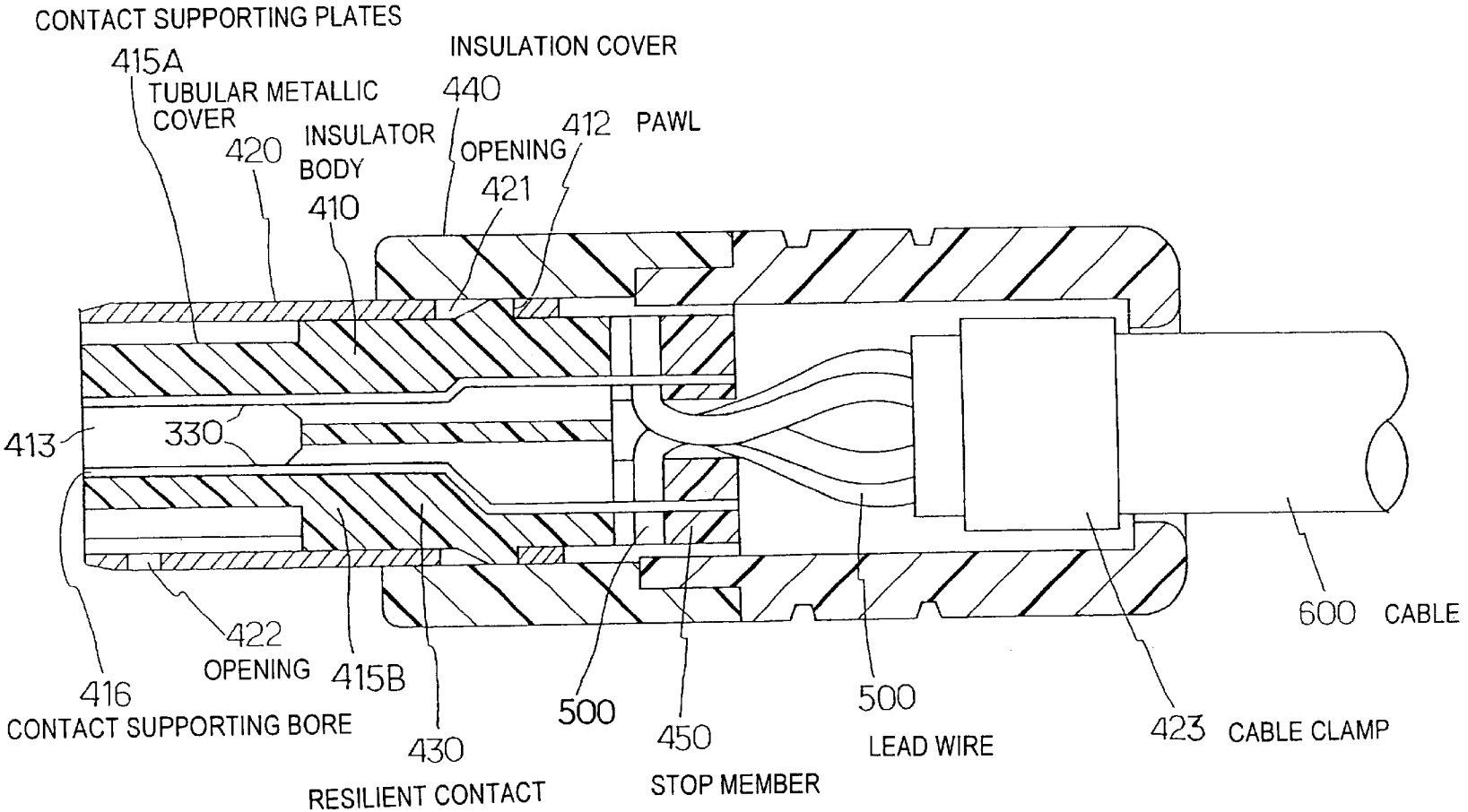
FIG. 33 is a cross-sectional view illustrating an embodiment of the connector plug according to this invention having thin line contacts or narrow strip contacts.

In the connector plug for this instance, contact accommodating grooves may be formed in the plate surface portions 414A, 414B of the contact supporting plates 415A, 415B, respectively as shown in FIG. 33 as is the case with the embodiment illustrated in FIGS. 5 and 7, and narrow strip contacts 330 may be accommodated in the respective contact accommodating grooves. The rest is the same as in the embodiment shown in FIG. 10.

As discussed above, according to this invention, for the so-called round type connector including semicylindrical connectors, a planar plate-like contact support is employed, and key bosses is used which have surfaces defining part of an annular groove 301 and surfaces parallel to the planar plate-like contact support for accommodating various types of connectors, so that wrong connection between different types of connector may be prevented by selecting the arrangements and configurations of the key bosses. As noted above, this invention provides for accommodating various types of connectors, and yet, the general round configuration makes it possible to reduce the size of the entire connector as compared to rectangular connectors. It will be appreciated that this advantage is equally true with the connector plug.

With regard to the contact arrangement as well, it is to be understood that narrow strip contacts or resilient contacts are arranged in juxtaposition on the plate surfaces of the planar plate-like contact support and of the contact supporting plate whereby the pitch of arrayed contacts may be reduced as compared with the conventional fashion in which contacts are accommodated in contact accommodating apertures. In addition, arranging contacts in juxtaposition on both of the opposite side surfaces of the planar plate-like contact support may increase the number of contacts that can be accommodated per unit space as well as contributing to reduction in size.

What is claimed is:

1. A connector socket including:

an insulator body integrally having a main body portion and a front portion extending forwardly from a front end of said main body portion, said front portion including a planar plate-like contact support and first key boss both extending forwardly from the front end of said main body portion;

a metallic cover surrounding the insulator body, said metallic cover having a forward portion forming at least a part of cylinder which defines a part of annular groove between said front portion of said insulator body and said cylinder for receiving therein a tubular metallic cover of a corresponding connector plug;

a plurality of contacts each formed of a narrow flat strip metal extending in an axial direction of said metallic cover and being arranged in juxtaposition with each other and supported on both of the opposite plate surfaces of the contact support at least one of said plurality of contacts having a forward end retracted rearwardly from that of the other contact or contacts and said planar plate-like contact support having protrusions in front of the forward ends of the contacts; and said first key boss having a side surface opposing the plate surface of the contact support in parallel thereto, a semi-cylindrical surface defining a part of inner periphery of said annular groove and at least one lateral surface which is perpendicular to the plate surface of the contact support, a position of the lateral surface along a width of the contact support uniquely defining a type of connector to distinguish from different types of connector sockets.

2. The connector socket set forth in claim 1 wherein:

said planar plate-like contact support is centered on the central axis, said plurality of contacts being supported on both the opposite plate surfaces of said planar plate-like contact support;

said insulator body including a second key boss extending forwardly from the front end of the main body portion on the side of said planar plate-like contact support opposite from said first key boss;

said second key boss having a side surface opposing said planar plate-like contact support in parallel thereto and a semi-cylindrical surface defining a part of inner periphery of said annular groove.

3. The connector socket set forth in claim 2 wherein:

said first key boss has a keyway formed in the surface opposing said planar plate-like contact support.

4. The connector socket set forth in claim 2 wherein:

the lateral surface of said first key boss is offset in width direction of the contact support from the center of said planar plate-like contact support.

5. The connector socket set forth in claim 2 wherein:

said second key boss has a lateral surface which is perpendicular to said planar plate-like contact support, the position of said lateral surface of the second key boss uniquely defining, together with the position of said lateral surface of the first key boss, the type of connector socket.

6. A connector socket including:

an insulator body integrally having a main body portion and a front portion extending forwardly form a front end of said main body portion, said front portion including a planar plate-like contact support and first key boss both extending forwardly from the front end of said main body portion;

a metallic cover surrounding the insulator body, said metallic cover having a forward portion forming at least a part of cylinder which defines a part of annular groove between said front portion of said insulator body and said cylinder for receiving therein a tubular metallic cover of a corresponding connector plug; and a plurality of contacts each formed of a narrow flat strip metal extending in an axial direction of said metallic cover and being arranged in juxtaposition with each other and supported on both of the opposite plate surfaces of the contact support, at least one of said plurality of contacts having a forward end retracted rearwardly from that of the other contact or contacts and said planar plate-like contact support having protrusions in front of the forward ends of the contacts; and said first key boss having a side surface opposing the plate surface of the contact support in parallel thereto, a semi-cylindrical surface defining a part of inner periphery of said annular groove and a keyway extending in said side surface in a direction in which said key boss extends, a position of said keyway along a width of the contact support uniquely defining a type of connector to distinguish from different types of connector sockets.

7. The connector socket set forth in claim 6 wherein:

the other of said opposite plate surfaces of said planar plate-like contact support is provided with a key, a position of said key in the width direction of said contact support uniquely defining the type of the connector socket.

8. The connector socket set forth in claim 7, wherein:

the surface of said insulator body on the side of said planar plate-like contact support opposite from said first key boss is a planar surface.

9. The connector socket set forth in claim 1 or 6 wherein:

said planar plate-like contact support is offset from an axial center of said insulator body in a direction perpendicular to the plate surface of said contact support; and said first key boss being positioned on the side of said axial center opposite from the side to which said contact support is offset.

10. The connector socket set forth in claim 1 or 6 wherein:

said insulator body has a bottom plate section forming an outer planar surface on a side where said first key boss is located , a part of said annular groove being defined between the bottom plate section and said first key boss.

11. The connector socket set forth in any of claims 1, 7, 2–5, and 6 wherein:

said planar plate-like contact support has opposite lateral surfaces cooperating with said metallic cover to define a part of said annular groove therebetween.

12. The connector socket set forth in any one of claims 1, 7, 2–5, and 6 wherein:

said planar plate-like contact support is generally parallel to a mounting surface of said connector socket for mounting a wiring board thereto.

13. the connector socket set forth in any one of claims 1, 7, 2–5, and 6 wherein:

The surface of the rear end portion of said metallic cover opposite from said wiring board mounting surface of said connector socket is a planar surface generally parallel to said mounting surface.

14. A connector plug including:

a tubular metallic cover;

an insulator body fitted in and fixed to the tubular metallic cover; and said insulator body having a contact support receiving slit diametrically cutout in its front face and extending in an axial direction of said metallic cover so as to define a first and second columnar plates on both sides of the contact supporting receiving slit, said first and second columnar plates having flat surfaces facing each other to define therebetween said contact support receiving slit and semi-cylindrical side surfaces in contact with inner periphery of said metallic cover;

a plurality of contacts extending in the axial direction of said metallic cover and being arranged in diametrically spaced and juxtaposed relation with each other on and supported by that flat surface of at least one of said first and second columnar plates, said resilient contacts having curved sections adjacent their forward ends protruding toward said slit, and having forward ends inserted and engaged by engagement bores formed in said columnar plate to prevent said resilient contacts from resiliently moving into said slit so that said resilient contacts are imparted resilient biasing force; and a keyway formed in one of said flat surface of said columnar plate and said semi-cylindrical side surface of said first columnar plate, position of said keyway along a width of said flat surface uniquely defining a type of the plug to distinguish from different types of plugs;

a stop member having a forward end fitted over a rear end portion of said metallic cover in abutment therewith and holding therein end portions of said resilient contacts, said stop member having a stepped rear face on which rear ends of said resilient contacts are exposed and soldered with lead wires of a cable;

a cable having a plurality of lead wires extended therefrom and soldered to the exposed end portions of said resilient contacts;

a clamp extended from rear end of said metallic cover and fixedly holding a forward end of said cable; and an insulation cover covering the rear end portion of said metallic cover, said stop member and a forward end portion of said cable.

15. The connector plug set forth in claim 14, wherein said contact support receiving slit is positioned eccentrically with respect to a central axis of said metallic cover, and said keyway is formed in said semi-cylindrical side surface of said first columnar plate and said plurality of contacts are extending on the flat surfaces of said first and second columnar plates.

16. The connector plug set forth in claim 14 wherein:

said contact support receiving slit is positioned eccentrically with respect to the central axis of said metallic cover, said plurality of contacts are extending on the flat surface of said second columnar plate, said keyway is formed in said flat surface of said first columnar plate; and said second columnar plate has a further flat surface in parallel to the flat surface of the second columnar plate;

a key formed on the further flat surface of said second columnar plate opposite from said slit to extend in the axial direction of said metallic cover.

17. The connector plug as set forth in claim 14 wherein:

a second keyway is formed in the semi-cylindrical surface of said second columnar plate, the positions and/or front end shapes of said first and second columnar plates defining the type of plug to distinguish from different types of connector plugs.

18. The connector plug set forth in claim 14 wherein:

said slit is generally centered on the central axis of said metallic cover, and said plurality of contacts extending in the axial direction of said metallic cover being supported by the flat surfaces of said first and second contact columnar plates.

19. The connector plug set forth in any one of claims 14–17, further including a stop member formed of an insulation material disposed behind said insulator body, wherein the rearward end portions of said contacts are passed through and extend out of said stop member to be soldered to corresponding lead wires extending from a cable; said connector plug further including a filler of resinous material surrounded by an insulation cover, said filler having the outer periphery of the rearward end portion of said metallic cover and the forward end portion of said cable embedded therein.

20. A connector assembly comprising the connector socket set forth in claim 7 or 8 or the connector plug set forth in claim 16.

21. A connector assembly comprising the connector socket set forth in claim 1 or the connector plug set forth in claim 14.

22. A connector assembly comprising the connector socket set forth in claim 12 or the connector plug set forth in claim 15.

23. A connector assembly comprising the connector socket set forth in clam 2 or the connector plug set forth in claim 18.

24. A connector assembly comprising the connector socket set forth in claim 4 or 5 or the connector plug set forth in claim 17.

25. A connector assembly comprising the connector socket set forth in claim 3 or the connector plug set forth in claim 17.

* * * * *